US011502468B2

(12) United States Patent
Eger et al.

(10) Patent No.: US 11,502,468 B2
(45) Date of Patent: Nov. 15, 2022

(54) METHODS FOR MOUNTING AND REPLACING BRUSHES

(71) Applicant: WABTEC HOLDING CORP., Wilmerding, PA (US)

(72) Inventors: Leo A. Eger, Murrysville, PA (US); John H. Parslow, Scotia, NY (US)

(73) Assignee: WABTEC HOLDING CORP., Wilmerding, PA (US)

( * ) Notice: Subject to any disclaimer, the term of this patent is extended or adjusted under 35 U.S.C. 154(b) by 681 days.

(21) Appl. No.: 16/281,910

(22) Filed: Feb. 21, 2019

(65) Prior Publication Data

US 2019/0181602 A1 Jun. 13, 2019

Related U.S. Application Data

(60) Continuation of application No. 15/834,679, filed on Dec. 7, 2017, now Pat. No. 10,270,216, which is a division of application No. 14/670,920, filed on Mar. 27, 2015, now Pat. No. 9,865,979.

(60) Provisional application No. 61/980,368, filed on Apr. 16, 2014.

(51) Int. Cl.
*H01R 39/38* (2006.01)
*H01R 43/12* (2006.01)

(52) U.S. Cl.
CPC ..... *H01R 39/381* (2013.01); *H01R 43/12* (2013.01)

(58) Field of Classification Search
CPC ..... H01R 39/381; H01R 43/12
See application file for complete search history.

(56) References Cited

U.S. PATENT DOCUMENTS

| | | | | |
|---|---|---|---|---|
| 7,608,970 | B2 * | 10/2009 | Eger | H01R 39/40 29/732 |
| 7,880,362 | B2 * | 2/2011 | Cutsforth | H01R 39/381 310/239 |
| 9,647,404 | B2 * | 5/2017 | Steinbach | H01R 39/58 |
| 2019/0181602 | A1 * | 6/2019 | Eger | H01R 39/381 |
| 2021/0126415 | A1 * | 4/2021 | Stewart | H01R 39/40 |

* cited by examiner

*Primary Examiner* — Minh N Trinh
(74) *Attorney, Agent, or Firm* — K&L Gates LLP

(57) ABSTRACT

A method of replacing a brush holder includes positioning a handle on the brush holder while the brush holder is connected to a support, rotating the handle relative to the brush holder in a first direction that is clockwise or counterclockwise to connect the handle to the brush holder, removing the brush holder from the support by pulling the handle with the handle attached to the brush holder, rotating the handle relative to the brush holder in a second direction that is opposite to the first direction while pulling a trigger on the handle that moves a core in the handle upward in a cavity in the handle, and removing the handle from the brush holder.

20 Claims, 26 Drawing Sheets

METHODS FOR MOUNTING AND REPLACING BRUSHES

PRIORITY CLAIM

The present application is a Continuation of U.S. patent application Ser. No. 15/834,679 filed Dec. 7, 2017, now U.S. Pat. No. 10,270,216 issued Apr. 23, 2019, which is a Divisional of U.S. patent application Ser. No. 14/670,920 filed Mar. 27, 2015, now U.S. Pat. No. 9,865,979 issued Jan. 9, 2018, which claims priority to U.S. provisional application Ser. No. 61/980,368 filed Apr. 16, 2014, the entire contents of which are incorporated herein by reference.

BACKGROUND

The present disclosure relates generally to assemblies that facilitate mounting and replacement of brushes that interact with a rotary electromechanical device. More specifically, the present disclosure is directed to an assembly that has a handle, a brush holder, and a support that connect and disconnect to each other using a locking mechanism.

Rotary electromechanical devices, such as commutators or slip rings, and associated carbon brushes and holders are used in numerous industrial contexts, such as power generation. A spring is typically used to maintain constant contact between the brush and the rotary electromechanical device. Eventually, wear on the brush hinders constant contact or secure positioning of the brush in the brush holder such that the brush must be replaced.

SUMMARY

In a general embodiment, the present disclosure provides a brush holder assembly comprising: a support comprising a post having a length; a brush holder comprising (i) a connecting member extending outward from a surface of the brush holder and (ii) a bore that extends from an opening in the connecting member to an opening on an opposite side of the surface relative to the connecting member, the bore having a length less than the length of the post; and a handle comprising (i) a shell configured to receive the connecting member and (ii) a core configured to receive the post.

An advantage of the present disclosure is to provide an improved brush holder assembly.

Another advantage of the present disclosure is to enhance safety and ease of brush mounting and replacement.

Still another advantage of the present disclosure is to improve the locking of the brush holder to the support.

Yet another advantage of the present disclosure is to increase the visibility of the locking indicator.

Another advantage of the present disclosure is to provide an improved handle interlock mechanism which prevents release of the handle from the holder until the brush holder is completely seated on the support.

Still another advantage of the present disclosure is to use under-the-brush retention to significantly reduce the necessary brush holder insertion force, for example by about 50%.

Additional features and advantages are described herein and will be apparent from the following Detailed Description and the Figures.

DETAILED DESCRIPTION

As used in this disclosure and the appended claims, the singular forms "a," "an" and "the" include plural referents unless the context clearly dictates otherwise. The words "comprise," "comprises" and "comprising" are to be interpreted inclusively rather than exclusively. Likewise, the terms "include," "including" and "or" should all be construed to be inclusive, unless such a construction is clearly prohibited from the context. However, the devices and assemblies disclosed herein may lack any element that is not specifically disclosed. Thus, a disclosure of an embodiment using the term "comprising" includes a disclosure of embodiments "consisting essentially of and "consisting of the components identified.

"Substantially the same" and "approximately" with respect to numerical values means within 10%, preferably within 5%, more preferably within 1%, even more preferably within 0.1%, and most preferably within 0.01%.

Figure 1B:
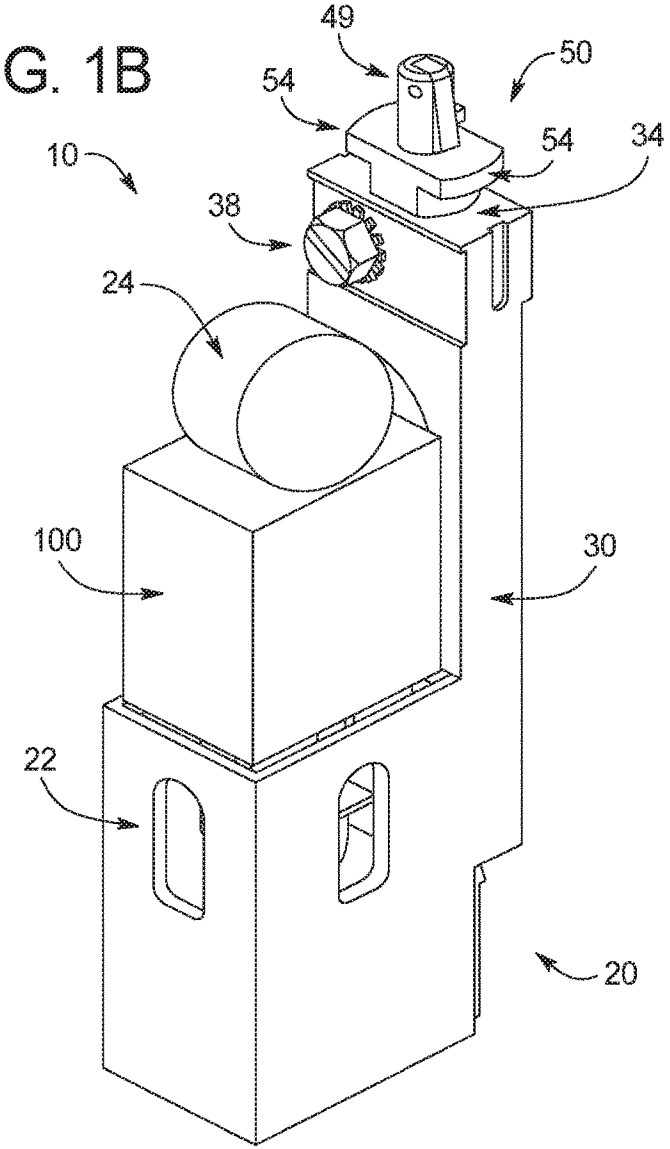
FIG. 1B shows a front perspective view of an embodiment of a brush holder assembly provided by the present disclosure.
Figure 1A:
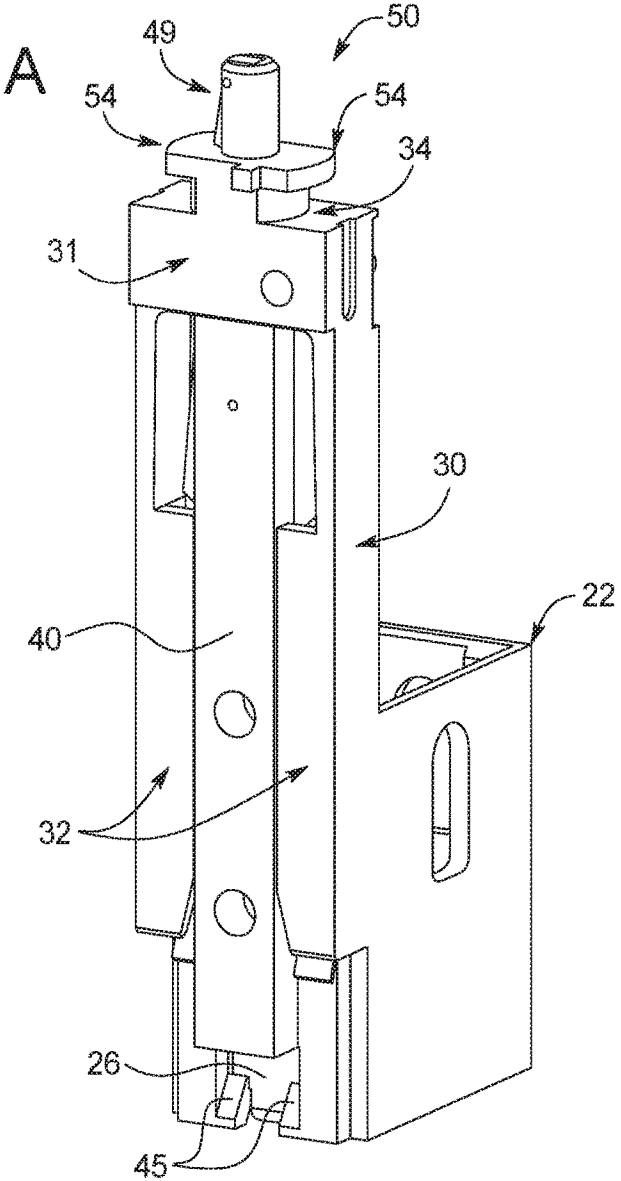
FIG. 1A shows a rear perspective view of an embodiment of a brush holder assembly provided by the present disclosure.

An embodiment of a brush holder assembly 10 provided by the present disclosure is shown in FIGS. 1A and 1B. The assembly 10 comprises a brush holder 20 and a support 40. The assembly 10 is configured to receive and retain a brush 100 and bias the brush 100 toward a surface of a rotary device such as a commutator or slip ring.

The brush holder 20 can comprise a brush box 22, a spring 24, and a back plate 30 which may be integral with the brush box 22. The brush box 22 is configured to receive at least a portion of the brush 100 and at least partially support and restrain movement of the brush 100 during operation. The brush holder 20 may comprise a retainer 26 that at least partially supports and restrains movement of the brush 100.

The spring 24 may be a ribbon spring or another biasing member and may be attached to at least one of the sides of the brush box 22 or the back plate 30. The spring 24 may be attached using rivets. Additionally or alternatively, the spring 24 may be attached by a loop at the end of the spring 24 which allows the spring 24 to be removable, as shown in FIG. 2C.

The back plate 30 may comprise extensions 32 configured to receive the support 40. The figures show two of the extensions 32, but any number of the extensions 32 can be used. The back plate 30 comprises an upper exterior surface 34 on which a connecting member 50 may be positioned. The connecting member 50 may be integral with and/or fixedly connected to the upper exterior surface 34 of the back plate 30.

Figure 2A:
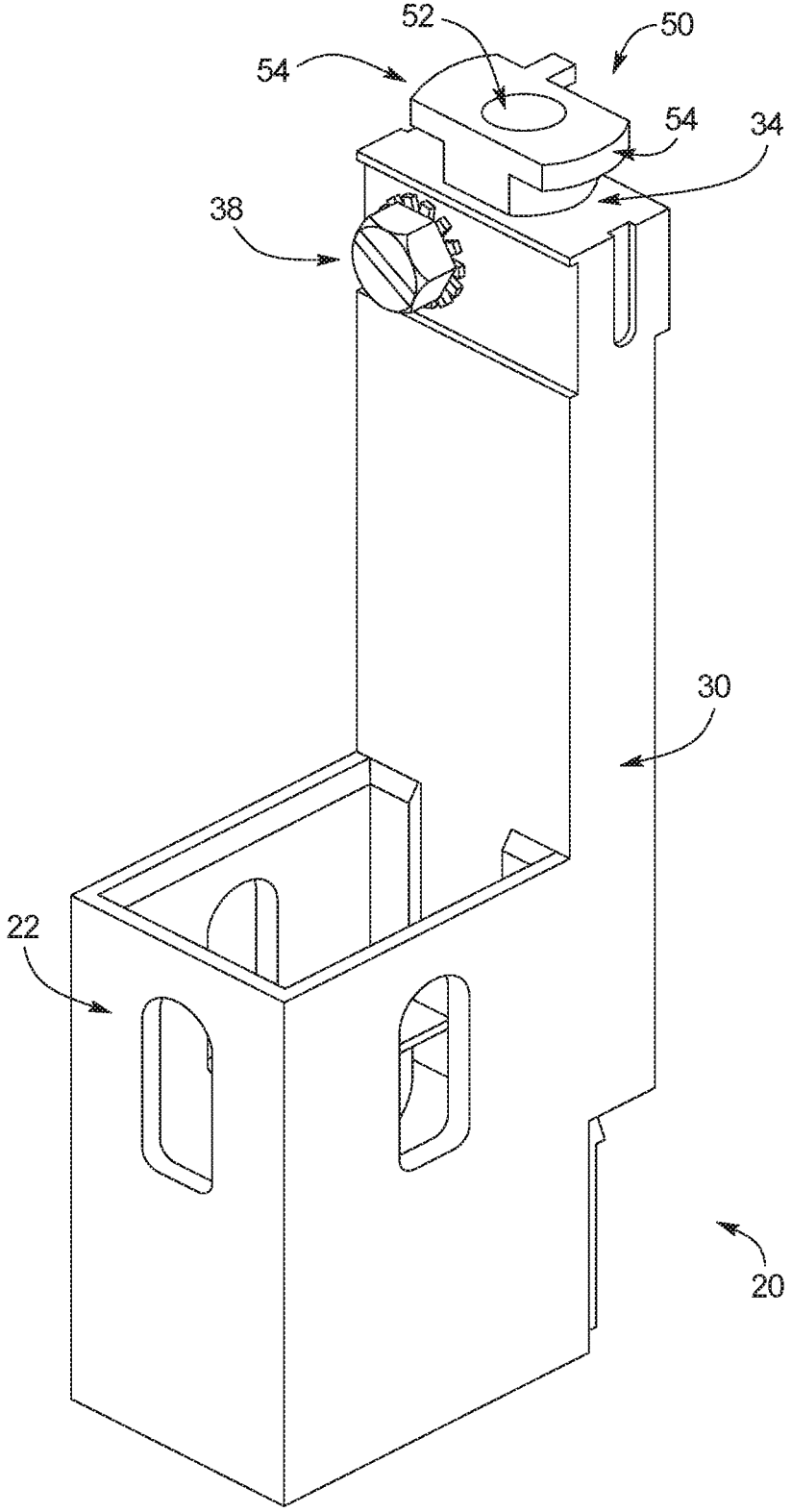
FIG. 2A shows a front perspective view of a brush holder in an embodiment of a brush holder assembly provided by the present disclosure.
Figure 2B:
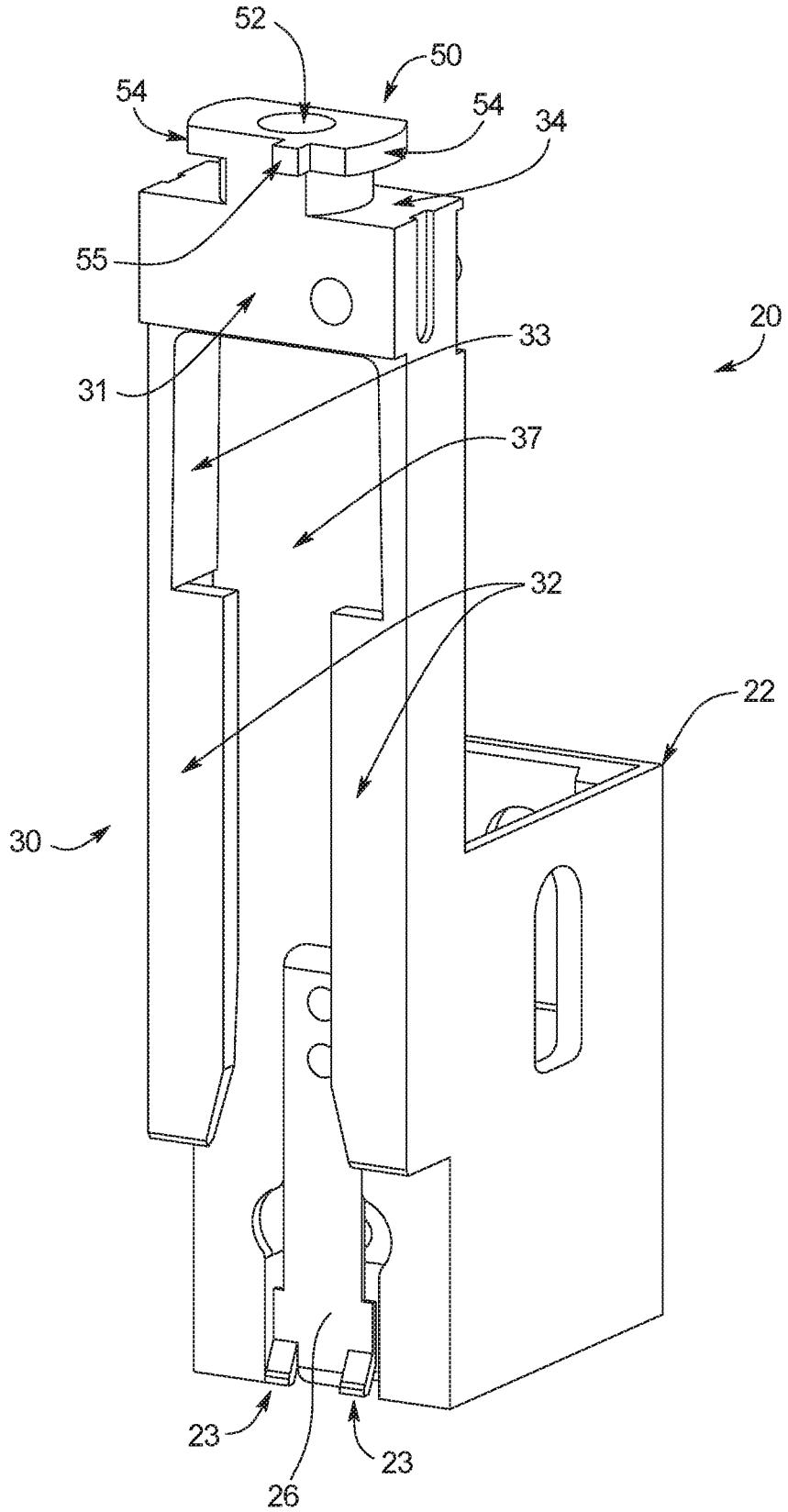
FIG. 2B shows a rear perspective view of a brush holder in an embodiment of a brush holder assembly provided by the present disclosure.
Figure 2C:
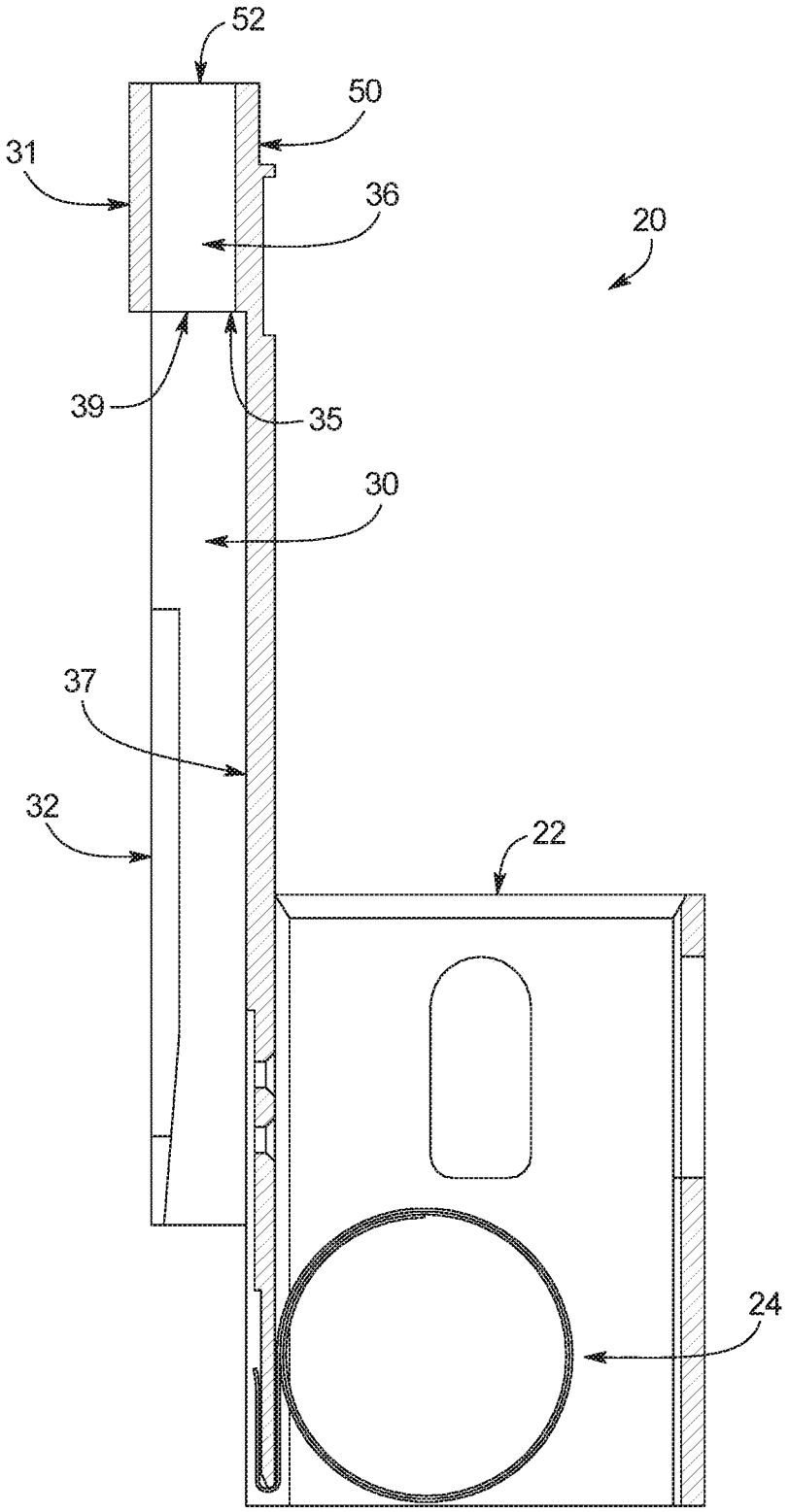
FIG. 2C shows a side cross-section view of a brush holder in an embodiment of a brush holder assembly provided by the present disclosure.

As shown in FIG. 2C, a central bore 36 can form an opening 52 in the connecting member 50 and an opening 39 in the upper interior surface 35 of the back plate 30. The central bore 36 can extend from the opening 52 in the connecting member 50, through the connecting member 50 and the back plate 30, to the opening 39 in the upper interior surface 35 of the back plate 30. The connecting member 50 may comprise a locking flange 54 that horizontally extends from opposite sides of the connecting member 50. A boss 55 may horizontally extend from one of the other sides of the connecting member 50.

As shown in FIGS. 1B and 2A, the back plate 30 may comprise an electrical connector 38. Although depicted as a terminal screw, the electrical connector 38 may be a quick-connect type terminal or another suitable component that provides an electrical connection to a lead of the brush 100.

Figure 3C:
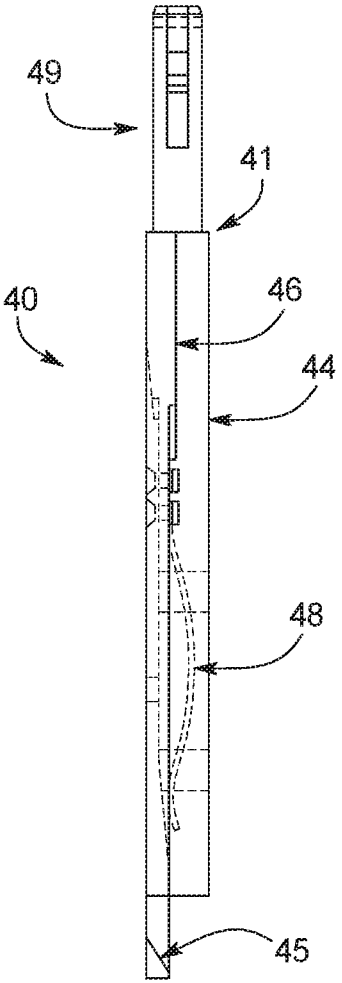
FIG. 3C shows a side plan view of a support in an embodiment of a brush holder assembly provided by the present disclosure.
Figure 3B:
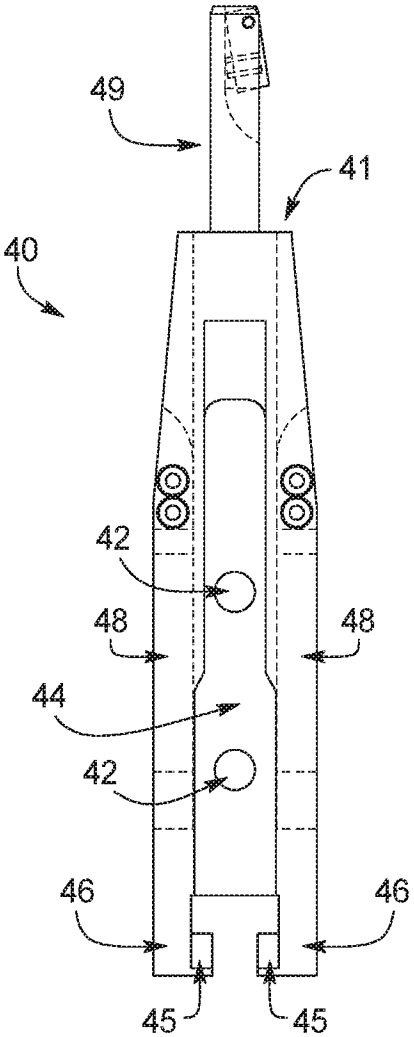
FIG. 3B shows a rear plan view of a support in an embodiment of a brush holder assembly provided by the present disclosure.
Figure 3A:
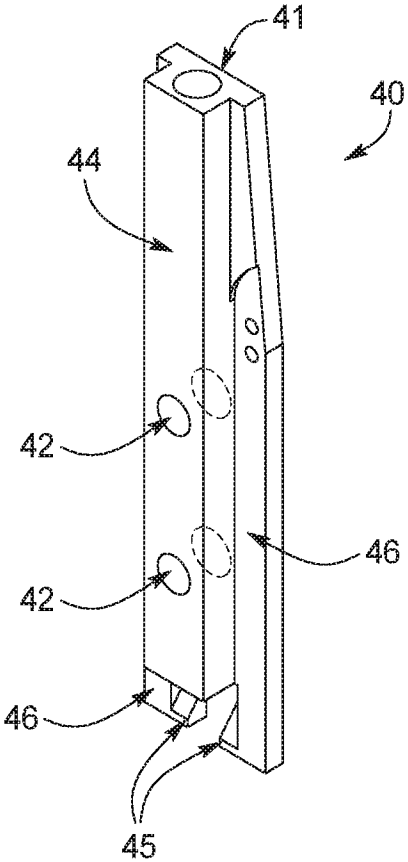
FIG. 3A shows a rear perspective view of a support in an embodiment of a brush holder assembly provided by the present disclosure.

As shown in FIGS. 3A and 3B, the support 40 may comprise one or more bores 42 that may receive a bolt or another fastener to fixedly connect the support 40 in a desired position. The one or more bores 42 can receive a brush-changing handle (not shown) instead of a bolt or fastener if the support 40 will be used to install a new or replacement brush.

As shown in FIGS. 3A-3C, the support 40 may comprise a body 44. The one or more bores 42 may extend through the body 44. The support 40 may comprise a support flange 46 that extends from opposite sides of the body 44, and the support flange 46 and the body 44 may form a T-shaped cross-section when viewed from above or below (see FIG. 3A).

Referring again to FIGS. 1A and 2B, the support 40 may be received by the brush holder 20. An upper interior surface 35 of the back plate 30, a rear interior surface 37 of the back plate 30, interior sides 33 of the back plate 30, and the extensions 32 may form a chamber that receives the support 40. The support 40 may be received with the top surface 41 of the support 40 abutting and/or proximate to the upper interior surface 35 of the back plate 30 and/or with the front surface 43 of the support 40 abutting and/or proximate to the rear interior surface 37 of the back plate 30. The extensions 32 and the rear interior surface 37 may maintain this position of the support 40 therebetween. To ensure a tight fit between the support 40 and the back plate 30, the distance between the extensions 32 of the back plate 30 may be substantially the same as the width of the body 44, and/or the width of the support flange 46 may be substantially the same as the width of the rear interior surface 37 of the back plate 30.

As shown in FIGS. 3B and 3C, the support flange 46 may comprise one or more contact springs 48, for example a pair of springs with one spring on each side of the body 44. The one or more contact springs 48 can bias against the extensions 32 when the support 40 is positioned within and/or against the back plate 30. The one or more contact springs 48 may maintain a position on the support 40 within and/or against the back plate 30 and may provide consistent electrical contact between the brush holder 20 and the support 40. Additionally or alternatively, the back plate 30 may comprise the one or more contact springs 48 such that the one or more contact springs 48 bias against the support 40. The back plate 30 may be removed from the support 40 by external force greater than the bias force of the one or more contact springs 48, for example by a user sliding or pulling the back plate 30 upward relative to the support 40. This embodiment is not limiting, and the support 40 may be connected to the back plate 30 using any mechanism known to one of ordinary skill.

As shown in FIGS. 3B and 3C, the support 40 comprises a post 49 that is integral with and/or fixedly connected to the top surface 41 of the support 40. FIG. 3A does not show the post 49 so that the T-shaped cross-section of the support 40 can be clearly seen, but this figure is not to be interpreted as a different embodiment of the support 40.

The central bore 36 has a length (the distance from the opening 52 in the connecting member 50 to the opening 39 in the upper interior surface 35 of the back plate 30) that is less than the length of the post 49. Thus the post 49 can completely extend through the central bore 36 as shown in FIGS. 1A and 1B. In a preferred embodiment, at least a portion of the central bore 36 and at least a portion of the post 49 have complementary cylindrical shapes. For example, the central bore 36 preferably has a radius and/or a circumference substantially the same as the radius and/or the circumference of the post 49, respectively. The post 49 can interact with the handle 60 as discussed in greater detail hereafter.

Figure 4B:
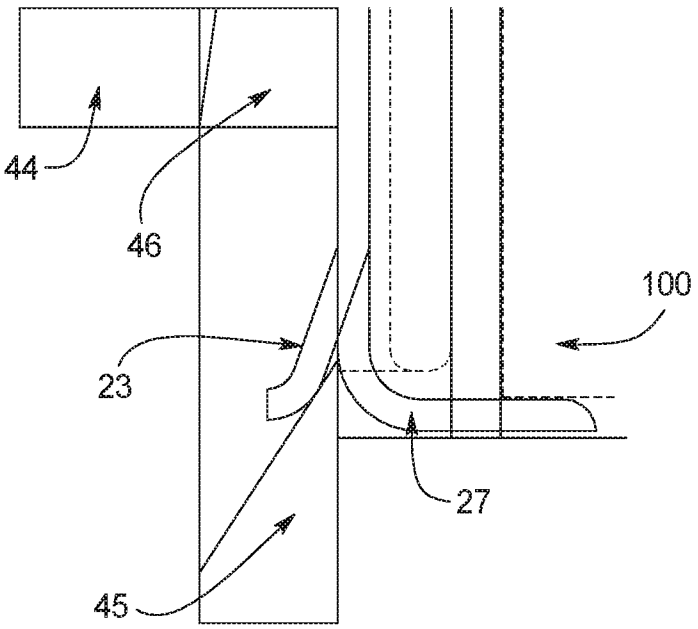
FIG. 4B is a magnified view of FIG. 4A.
Figure 4A:
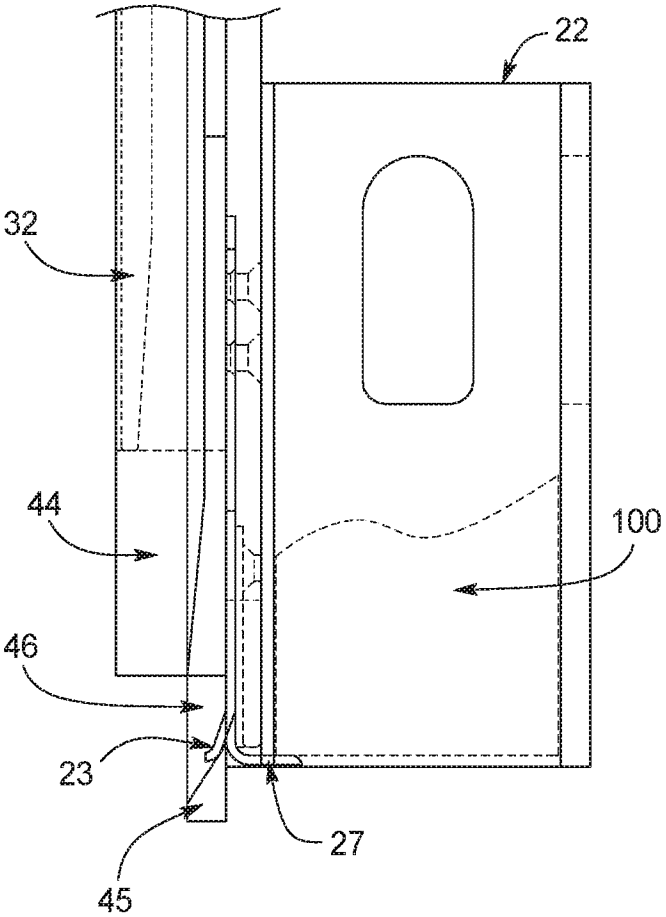
FIG. 4A shows a side cross-section view of the retainer restraining the brush in the brush box in an embodiment of a brush holder assembly provided by the present disclosure.

As shown in FIGS. 4A and 4B, the retainer 26 can comprise a leg 27 that, in a resting state, horizontally extends into the brush box 22 and is coplanar with and/or proximate to the bottom of the brush box 22. When the brush 100 is received by the brush box 22, the leg 27 of the retainer 26 retains the brush 100 in the brush box 22 by contacting the bottom surface of the brush 100. The retainer 26 may securely hold the brush 100 against unwanted movement during installation or removal. The retainer 26 may comprise one or more extensions 23 that extend from an opposite side of the retainer 26 relative to the leg 27.

Figure 4D:
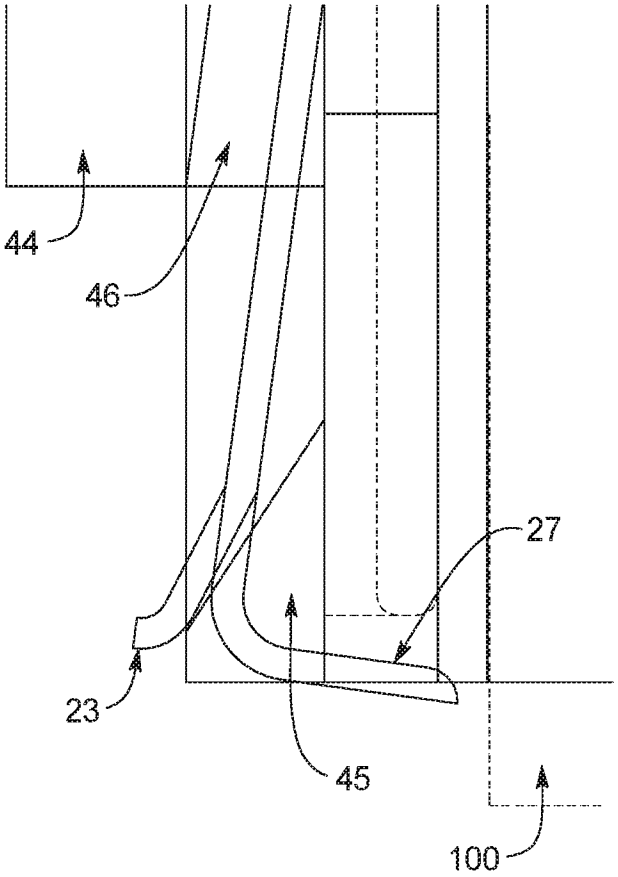
FIG. 4D is a magnified view of FIG. 4C.
Figure 4C:
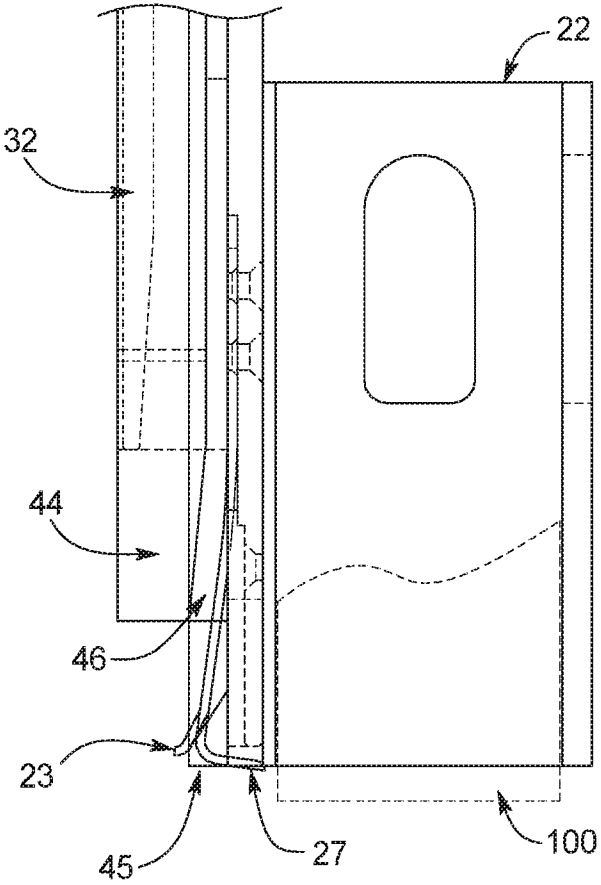
FIG. 4C shows a side cross-section view of the retainer releasing the brush from the brush box in an embodiment of a brush holder assembly provided by the present disclosure.

As shown in FIGS. 4C and 4D, the one or more extensions 23 of the retainer 26 may be lifted by cams 45 on the support 40. The cams 45 may be part of the support flange 46. Lifting of the one or more extensions 23 by the support 40 rotates the leg 27 of the retainer 26 slightly backward away from the wall of the brush box 22 that is adjacent to the back plate 30 to release the brush 100 from the brush box 22.

As shown in FIGS. 5A-5F, the handle 60 may comprise a stem 62 and may comprise a shell 64 that forms a base of the handle 60. The stem 62 may be fixedly connected to the shell 64 so that rotation of the stem 62 rotates the shell 64. For example, threads 61 on the stem 62 may mate with complementary threads 63 on the shell 64, although any connection known to one of ordinary skill may be used. The stem 62 may comprise insulation 65 that may enable the handle 60 to be attached, used and removed while the rotary device is energized or rotating.

The handle 60 can comprise a cavity 66 within the shell 64 and can further comprise a core 70 moveably positioned in the cavity 66. The shell 64, including shell teeth 78 at the bottom of the shell 64, and the core 70 enable the handle 60 to receive and connect to the connecting member 50 which is part of the back plate 30 of the brush holder 20 as discussed in detail hereafter. Preferably, the inside diameter of the cavity 66 is substantially the same as the outside diameter of the core 70. The height of the cavity 66 is such as to allow the core 70 to travel within the cavity 66 to facilitate selective engagement of the core 70 with the locking flange 54.

The shell 64 of the handle 60 can comprise a stop 79 extending downward from the shell 64. The stop 79 can abut the rear exterior surface 31 of the back plate 30 of the brush holder 20 when the handle 60 is connected to the back plate 30.

The core 70 may comprise a recess 80 on the bottom surface of the core 70, and the recess 80 may be a vertical cylindrical recess having a central axis along the vertical axis of the core 70 and/or the vertical axis of the handle 60. Preferably the recess 80 has a radius and/or a circumference that is substantially the same as the radius and/or the circumference of the post 49, respectively. The recess 80 may have a lobe at a larger radius along a portion of the circumference to allow locking of brush holder assembly 10 and the handle 60 to the support 40 until the handle 60 is at the extents of its rotational travel. The core 70 may further comprise core teeth 74 that extend downward from the bottom surface of the core 70 on opposite sides of the recess 80. Preferably, the distance between the core teeth 74 is substantially the same as the width of the locking flange 54.

The shell teeth 78 can extend inward from opposite inner sides of the shell 64 in a direction that is substantially horizontal. The shell teeth 78 preferably do not vertically overlap the core teeth 74. Preferably, the inner diameters and widths of the shell teeth 78 are substantially the same as the outer dimensions of the locking flange 54.

A compression spring 72 may be positioned at least partially within the cavity 66 and may extend from the stem 62 to abut the top surface of the core 70. Force upon the bottom of the core 70 may slide the core 70 upward within the cavity 66, but the compression spring 72 nominally biases the core 70 downward in the cavity 66 against the top of the shell teeth 78 in a resting state. In an embodiment, the compression spring 72 nominally biases the core 70 downward such that the shell teeth 78 are in substantially the same horizontal plane as the core teeth 74.

Figure 5C:
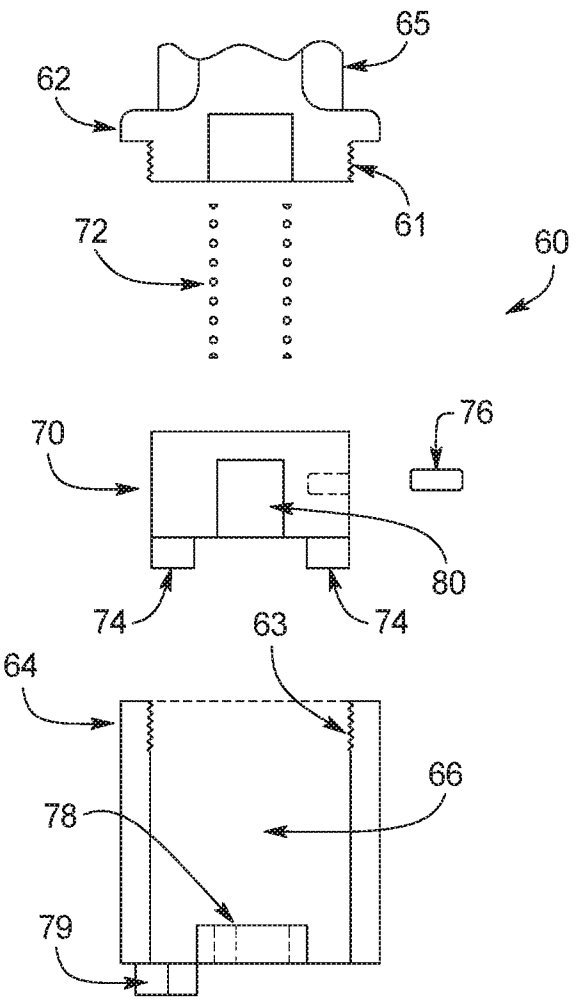
FIG. 5C shows an exploded view of a handle in an embodiment of a brush holder assembly provided by the present disclosure.
Figure 5B:
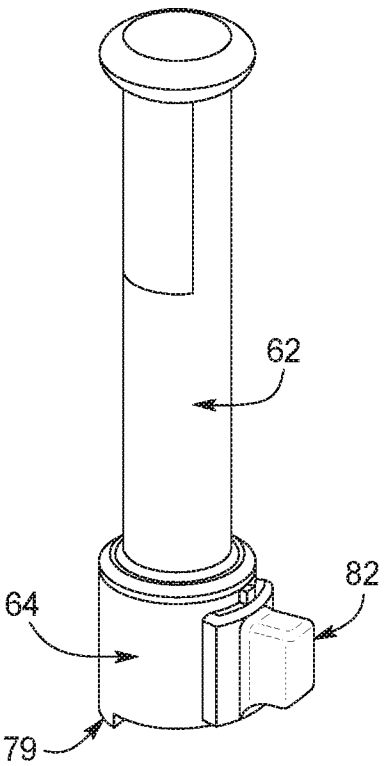
FIG. 5B shows a front perspective view of a handle in an embodiment of a brush holder assembly provided by the present disclosure.
Figure 5A:
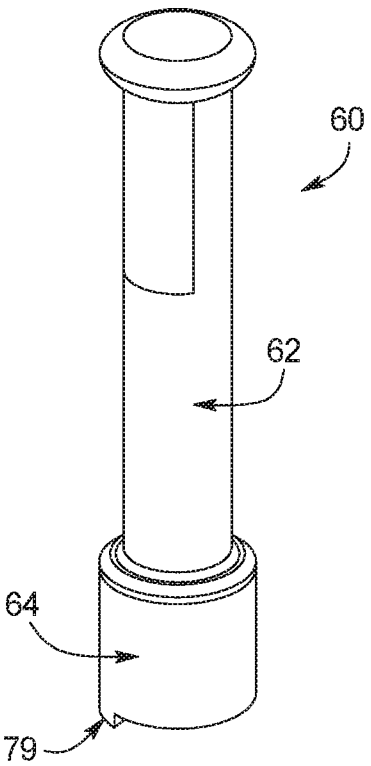
FIG. 5A shows a front perspective view of a handle in an embodiment of a brush holder assembly provided by the present disclosure.
Figure 5D:
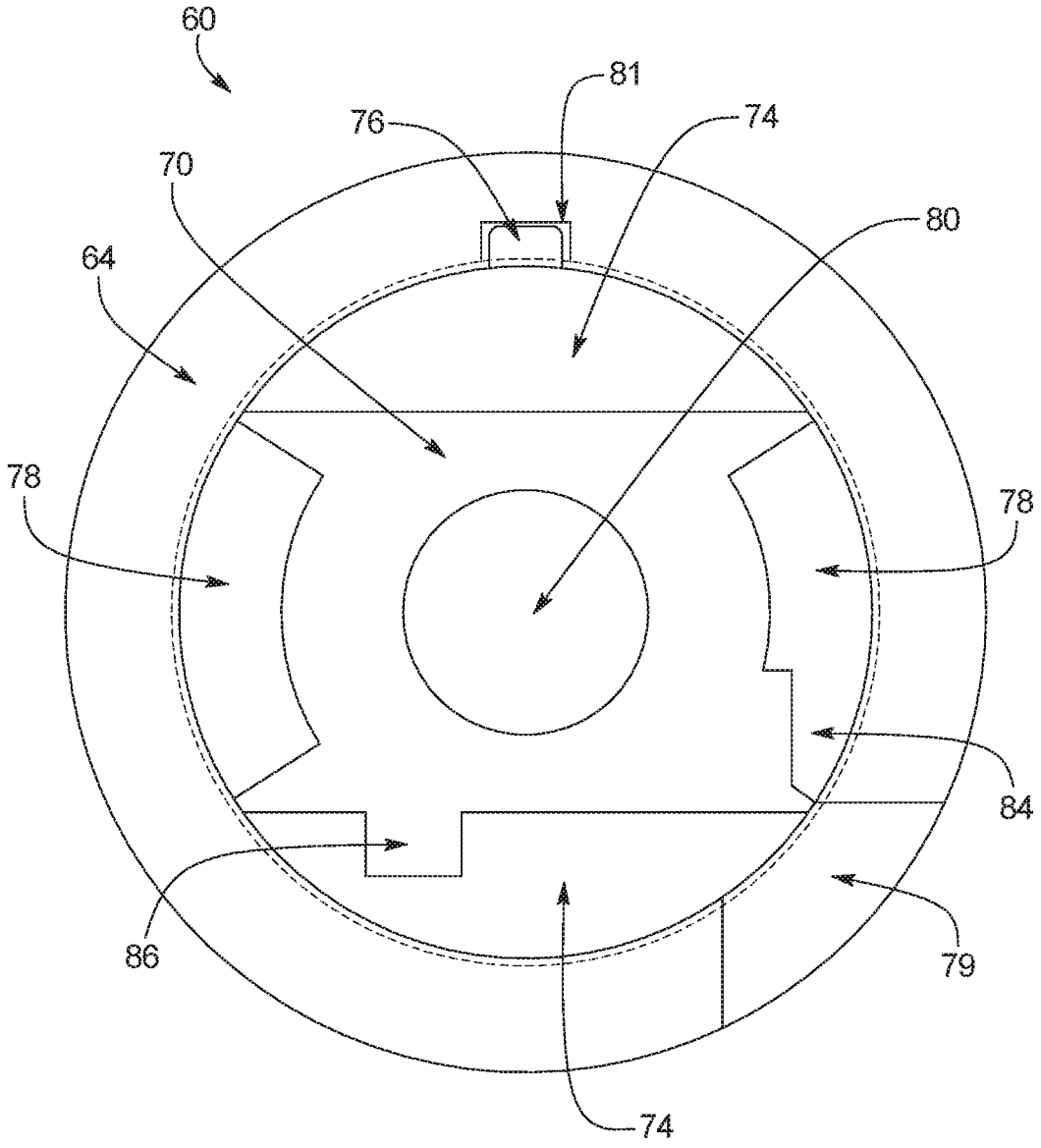
FIG. 5D shows a bottom plan view of a handle in an embodiment of a brush holder assembly provided by the present disclosure.
Figure 5E:
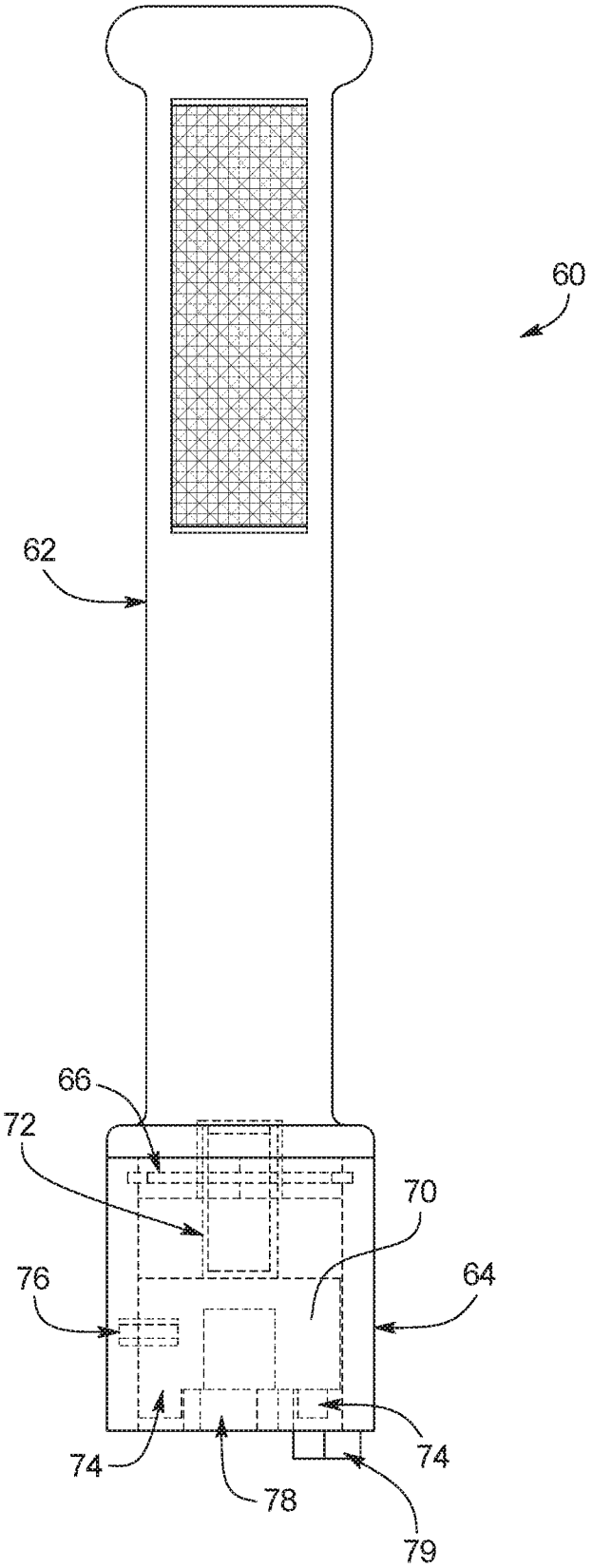
FIG. 5E shows a side cross-section view of a handle in an embodiment of a brush holder assembly provided by the present disclosure.
Figure 5F:
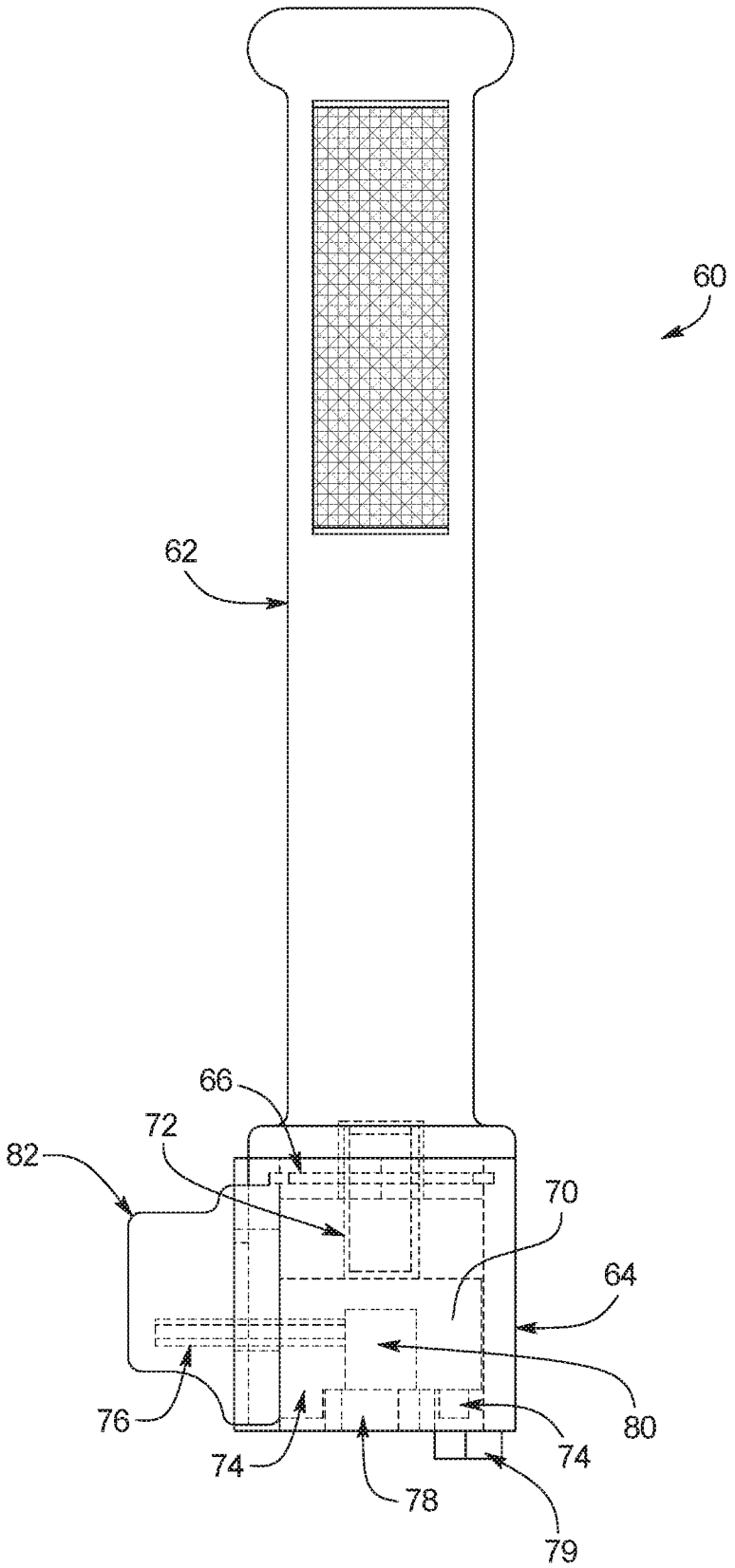
FIG. 5F shows a side cross-section view of a handle in an embodiment of a brush holder assembly provided by the present disclosure.

The core 70 can comprise a pin 76 that extends outward horizontally from the core 70 into a slot 81 in the shell 64. In an embodiment shown in FIGS. 5B and 5F, the pin 76 may extend through the slot 81 and into a trigger 82 on the exterior of the shell 64. In such an embodiment, the pin 76 inserts into the trigger 82 so that a user pulling the trigger 82 upward slides the pin 76 upward in the slot 81 and thereby slides the core 70 upward in the cavity 66, against the biasing of the compression spring 72. As shown in FIGS. 5A and 5E, the trigger 82 is an optional feature, and an embodiment of the handle 60 does not have the trigger 82.

Figure 5G:
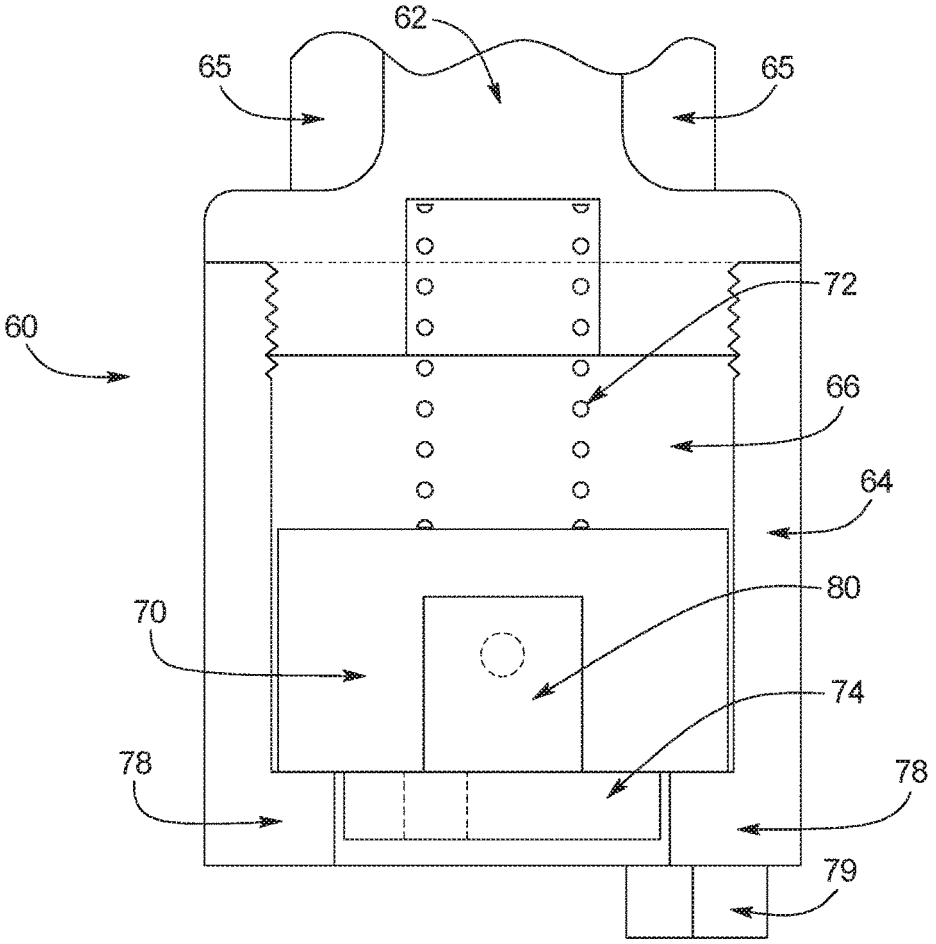
FIG. 5G shows a cross-section view, from the front of the brush holder, of a handle in the locked position in an embodiment of a brush holder assembly provided by the present disclosure.
Figure 5H:
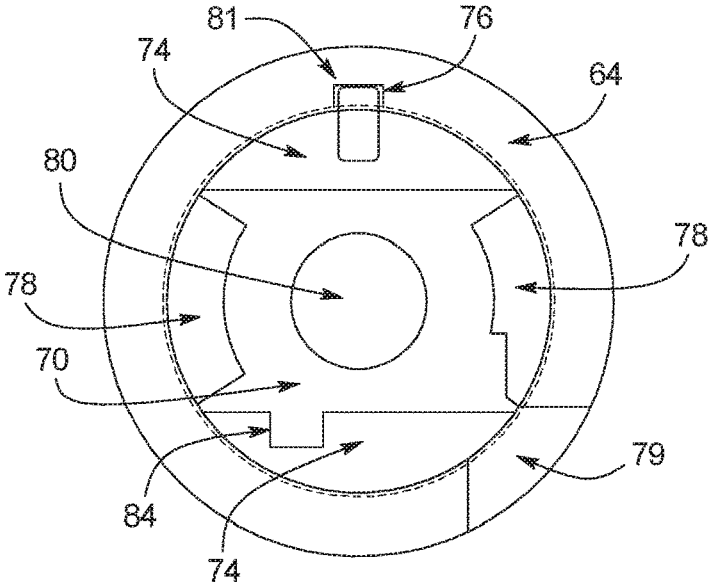
FIG. 5H shows a bottom cross-section view of the locked position of the handle shown in FIG. 5G.
Figure 5I:
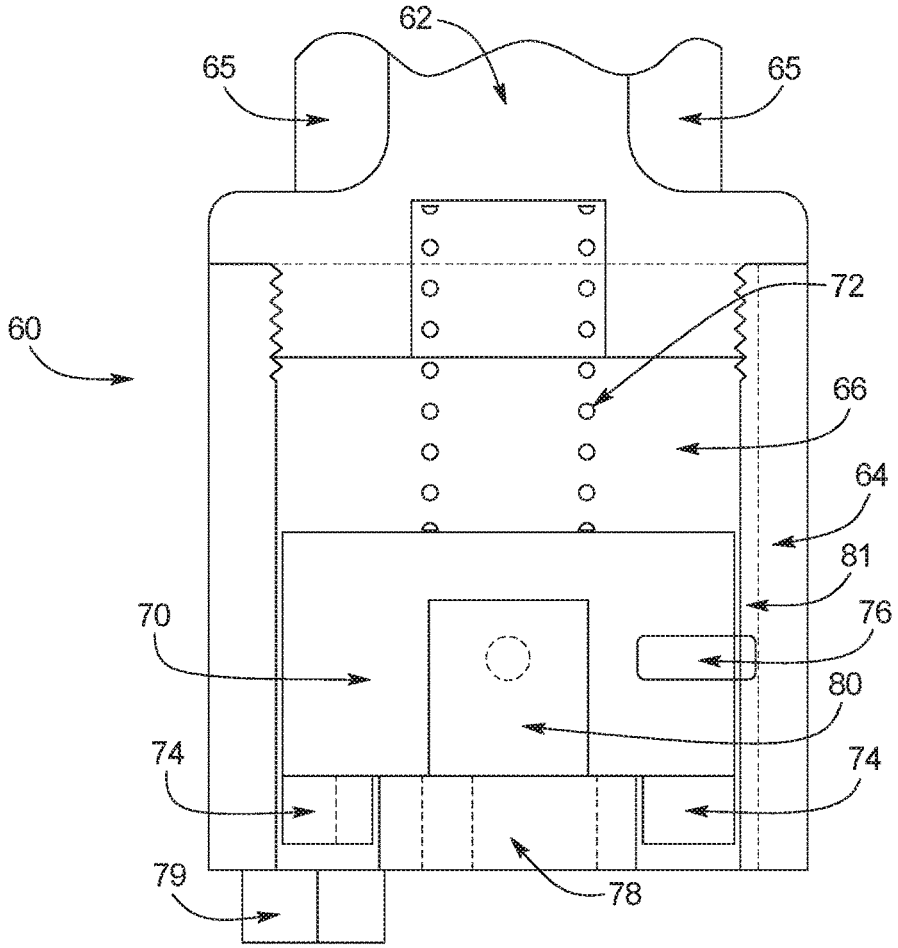
FIG. 5I shows a cross-section view, from the front of the brush holder, of a handle in an unlocked position in an embodiment of a brush holder assembly provided by the present disclosure.
Figure 5J:
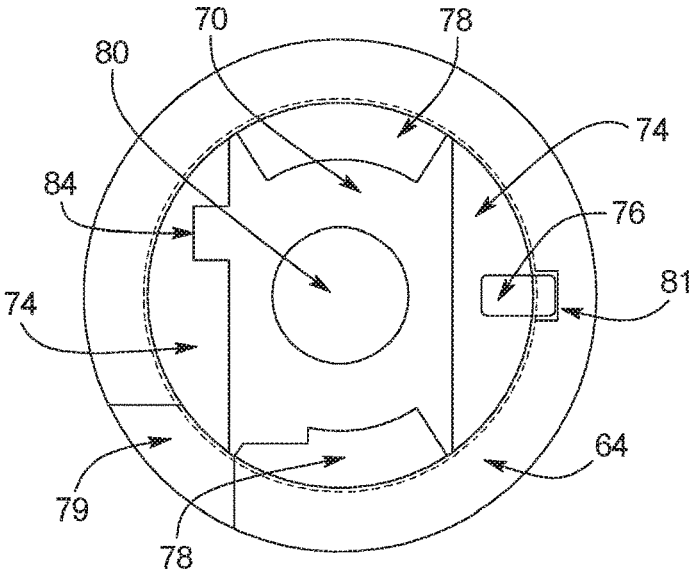
FIG. 5J shows a bottom cross-section view of the unlocked position of the handle shown in FIG. 5I.

FIGS. 5G and 5H show the handle 60 in an orientation as viewed from the front of the brush holder 20, and this orientation would lock the handle 60 to the brush holder 20. In an embodiment, the locked position of the handle 60 situates the core teeth 74 in the front and the rear of the cavity 66 relative to the front of the brush holder 20 and situates the shell teeth 78 on the lateral sides of the cavity 66. FIGS. 5I and 5J show the handle 60 in an unlocked orientation, as viewed from the front of the brush holder 20; the handle 60 is shown mounted to the brush holder 20 in this view. In an embodiment, the unlocked position of the handle 60 situates the shell teeth 78 in the front and the rear of the cavity 66 relative to the front of the brush holder 20 and situates the core teeth 74 on the lateral sides of the cavity 66. Preferably the handle 60 is rotated by approximately ninety degrees to move from the unlocked position to the locked position and rotated in the opposite direction by approximately ninety degrees to return to the unlocked position. Movement of the handle 60 between the locked position and the unlocked position is discussed in further detailed hereafter in reference to FIGS. 8A-L and 9A-H.

Figure 6A:
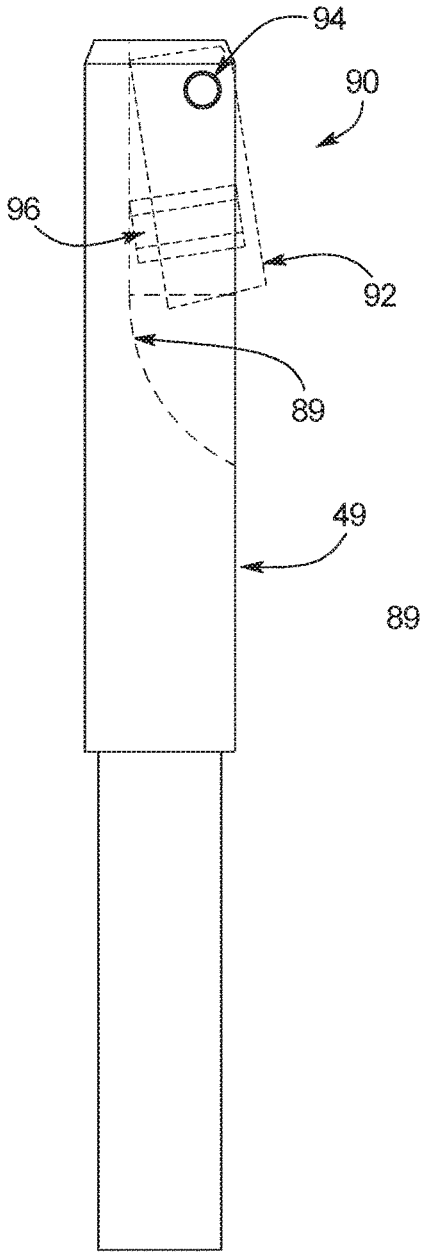
FIG. 6A shows a side plan view of a post provided by the support in an embodiment of a brush holder assembly provided by the present disclosure.
Figure 6B:
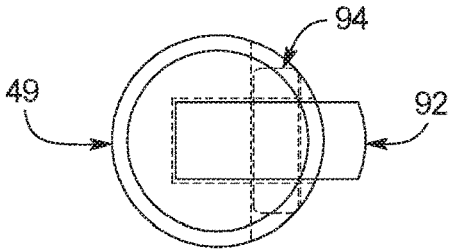
FIG. 6B shows an above plan view of a post provided by the support in an embodiment of a brush holder assembly provided by the present disclosure.
Figure 6C:
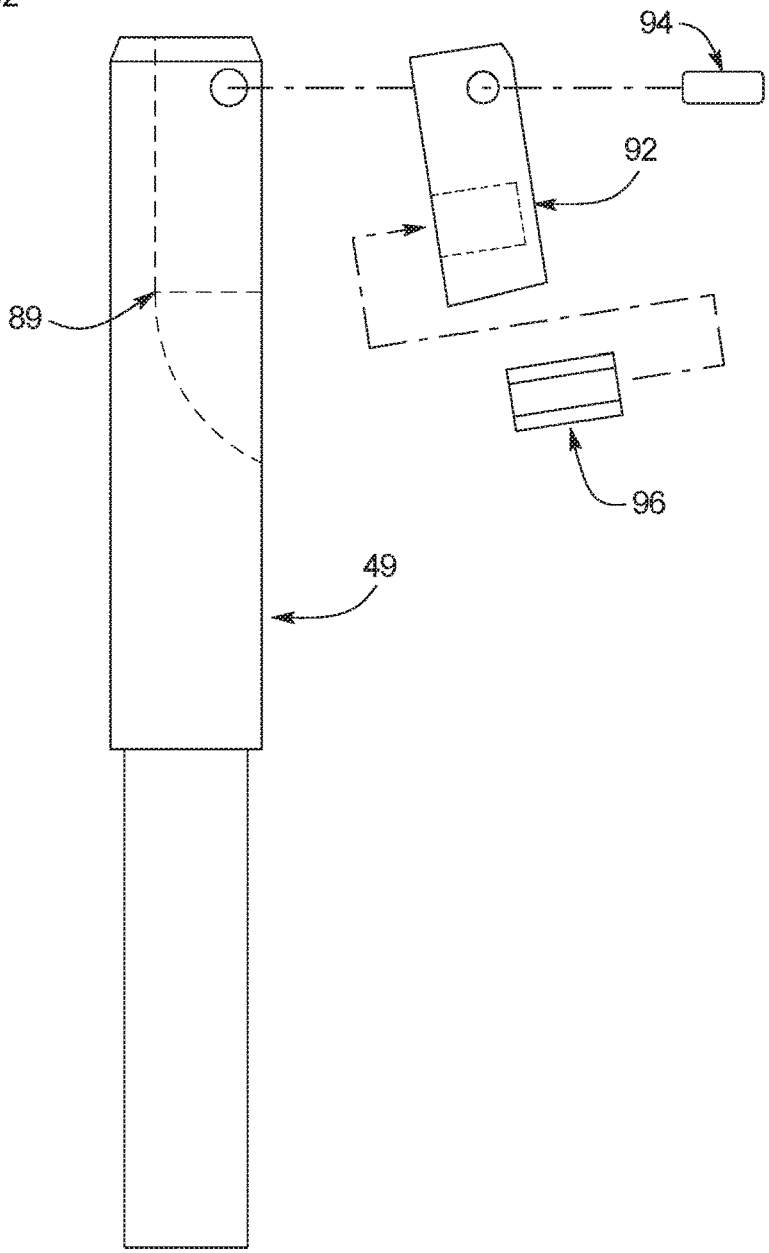
FIG. 6C shows an exploded view of a post provided by the support in an embodiment of a brush holder assembly provided by the present disclosure.

As shown in FIGS. 6A-6C, the post 49 can comprise a rocker assembly 90. A portion of the post 49 can extend out of the connecting member 50 when the support 40 is connected to the brush holder 20, and this portion of the post 49 can comprise a slot 89 in which the rocker assembly 90 can be positioned. For example, the bottom of the rocker assembly 90 can be positioned on the post 49 at a distance from the top surface 41 of the support 40 that is at least equal to the length of the central bore 36.

The rocker assembly 90 can comprise a rocker arm 92, a pin 94 that connects the rocker arm 92 to the post 49, and a rocker spring 96 positioned at least partially between the post 49 and the rocker arm 92. The rocker arm 92 can rotate on the pin 94, and the rocker spring 96 can nominally bias the bottom end of the rocker arm 92 outward such that the bottom end of the rocker arm 92 extends outward from the slot 89 in a resting state.

Figure 7A:
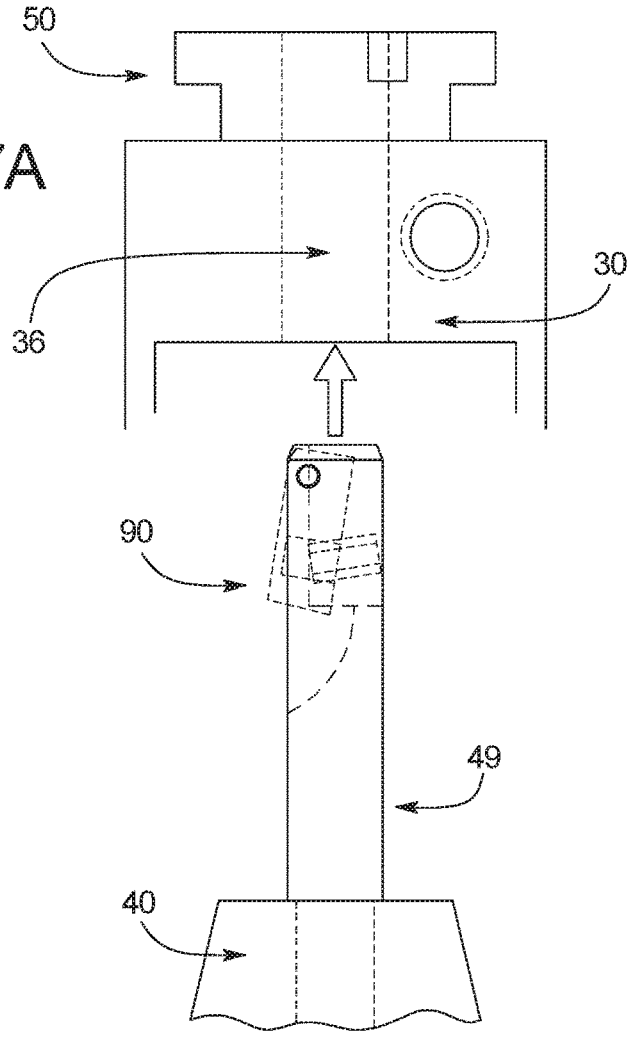
FIG. 7A shows a rear cross-section view of a support and a brush holder before their connection in an embodiment of a brush holder assembly provided by the present disclosure.

FIGS. 7A-7D generally illustrate attachment of the support 40 to the back plate 30 of the brush holder 20 in the absence of the handle 60. As shown in FIG. 7A, the post 49 of the support 40 can be aligned with the central bore 36 of the back plate 30 of the brush holder 20 to prepare for connection of the support 40 to the back plate 30. The bottom end of the rocker arm 92 is rotated outward from the slot 89 of the post 49 by the rocker spring 96 in this resting state of the rocker assembly 90.

Figure 7B:
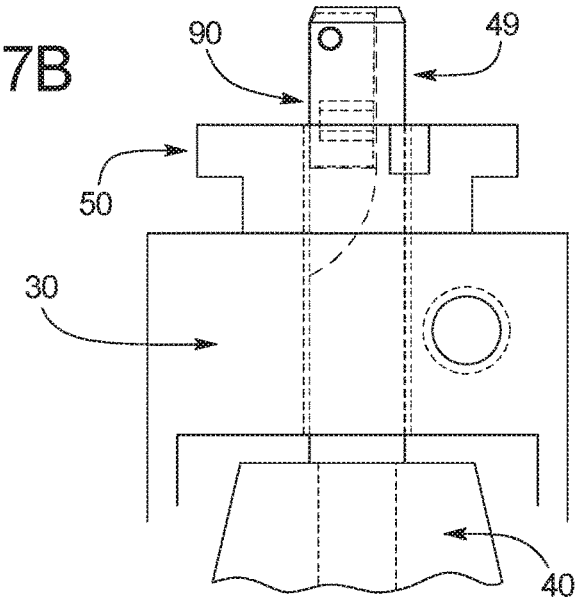
FIG. 7B shows a rear cross-section view of a brush holder partially seated on a support in an embodiment of a brush holder assembly provided by the present disclosure.

As shown in FIG. 7B, the post 49 of the support 40 is inserted into the central bore 36 as the support 40 connects to the back plate 30. The bottom end of the rocker arm 92 is rotated inward into the slot 89 of the post 49 by a restrictive circumference of the central bore 36, which compresses the rocker spring 96.

Figure 7C:
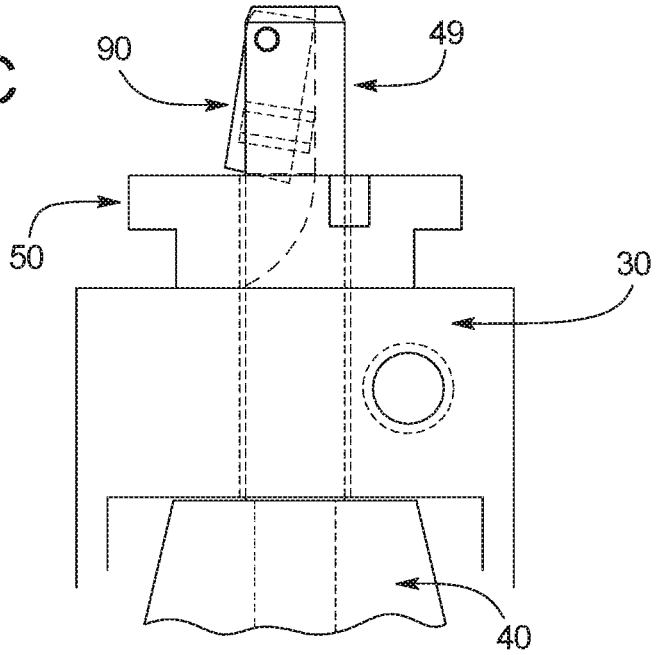
FIG. 7C shows a rear cross-section view of a brush holder fully seated on a support in an embodiment of a brush holder assembly provided by the present disclosure.
Figure 7D:
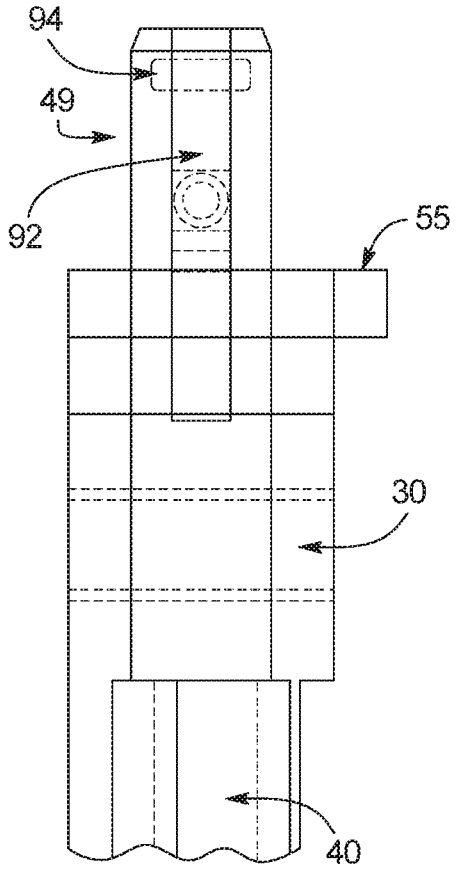
FIG. 7D shows a side cross-section view of a support and a brush holder after their connection in an embodiment of a brush holder assembly provided by the present disclosure.

As shown in FIGS. 7C and 7D, a portion of the post 49 extends from the central bore 36 after the support 40 is fully connected to the back plate 30. The bottom end of the rocker arm 92 is rotated outward from the post 49 by the emergence of the rocker arm 92 from the central bore 36, which frees the rocker assembly 90 from the restrictive circumference of the central bore 36 and allows the rocker spring 96 to extend. Extension of the rocker arm 92 outward from the post 49 provides a visual indication that the brush holder 20 is fully seated on the support 40 and locks the brush holder 20 to the support 40.

FIGS. 8A-8L generally illustrate connection of the support 40, the brush holder 20, and the handle 60 to each other. These figures also depict a first method provided by the present disclosure. The steps disclosed hereafter can be performed in any order and are not limited to the specific order shown in the figures. In these figures, the outer dashed line is the perimeter of the locking flange 54, and the inner, circular dashed line is the perimeter of the connecting member 50.

Figure 8A:
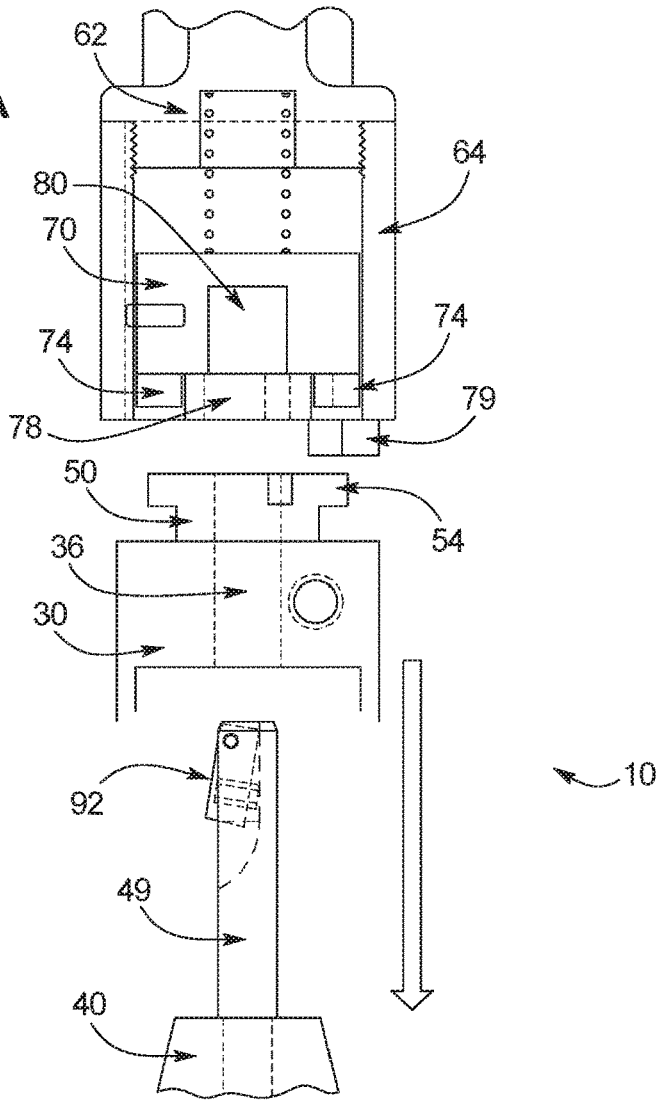
FIG. 8A shows a rear cross-section view of an embodiment of a brush holder assembly provided by the present disclosure.
Figure 8B:
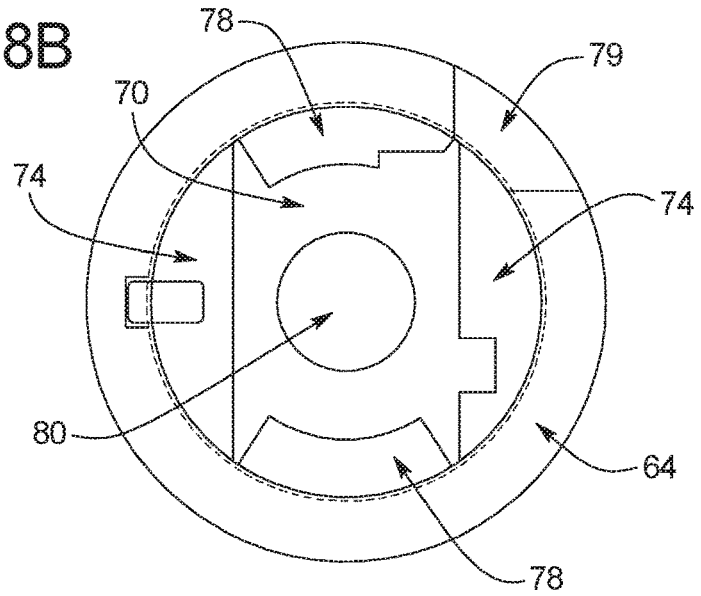
FIG. 8B shows a bottom cross-section view of the configuration of the embodiment of a brush holder assembly shown in FIG. 8A.
Figure 8C:
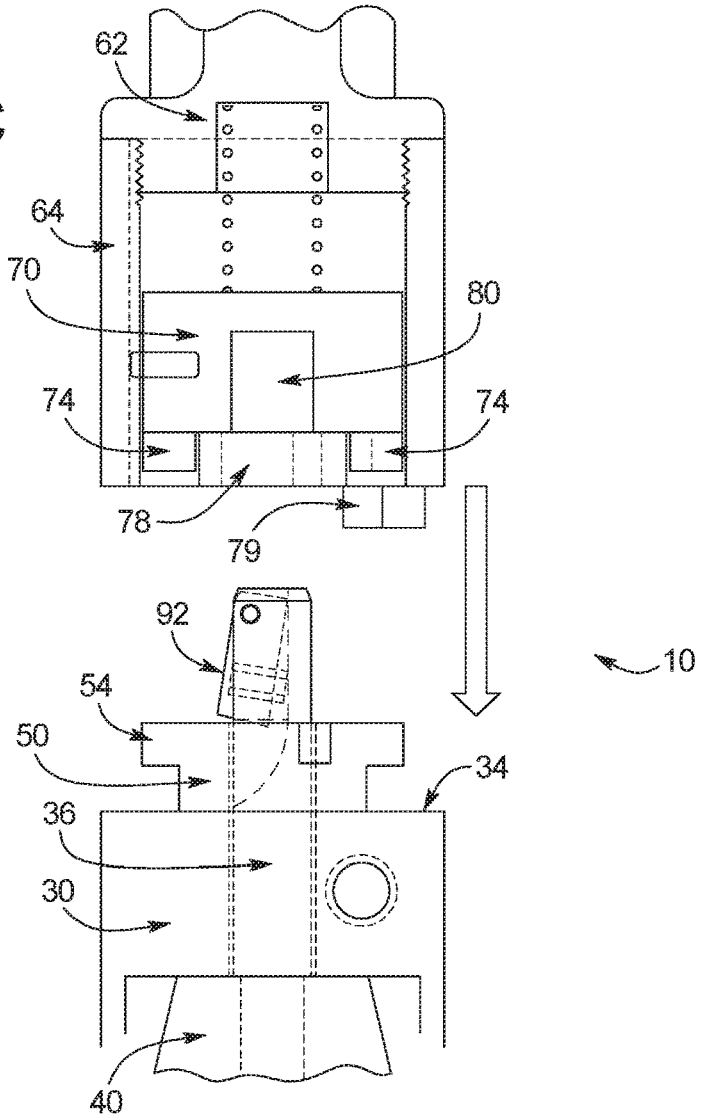
FIG. 8C shows a rear cross-section view of an embodiment of a brush holder assembly provided by the present disclosure.
Figure 8D:
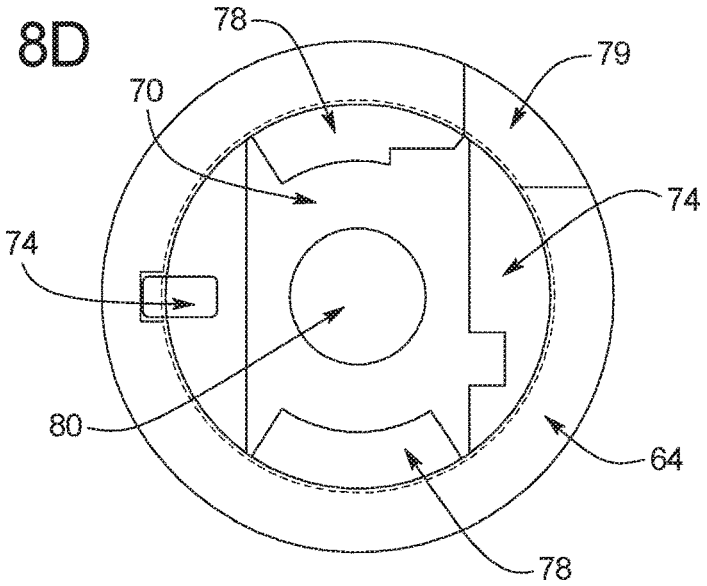
FIG. 8D shows a bottom cross-section view of the configuration of the embodiment of a brush holder assembly shown in FIG. 8C.

As shown in FIGS. 8A and 8B, which depict step (1) of the first method, a user can align the handle 60 with the connecting member 50 and/or align the support 40 with the back plate 30 of the brush holder 20. Then the back plate 30 can be moved onto the support 40. As shown in FIGS. 8C and 8D, which depict step (2) of the first method, connection of the brush holder 20 to the support 40 extends the rocker assembly 90 in the post 49 outward through the connecting member 50. Additionally or alternatively, the handle 60 can be mounted on the brush holder 20 before and/or during this step.

Figure 8E:
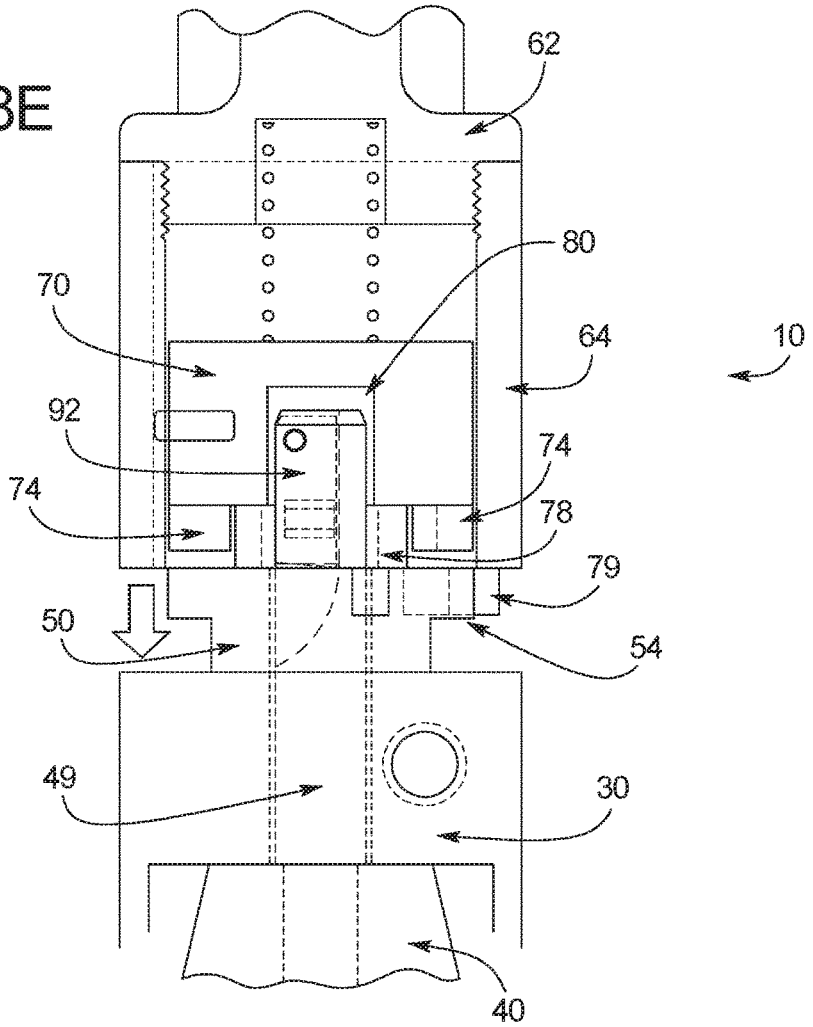
FIG. 8E shows a rear cross-section view of an embodiment of a brush holder assembly provided by the present disclosure.
Figure 8F:
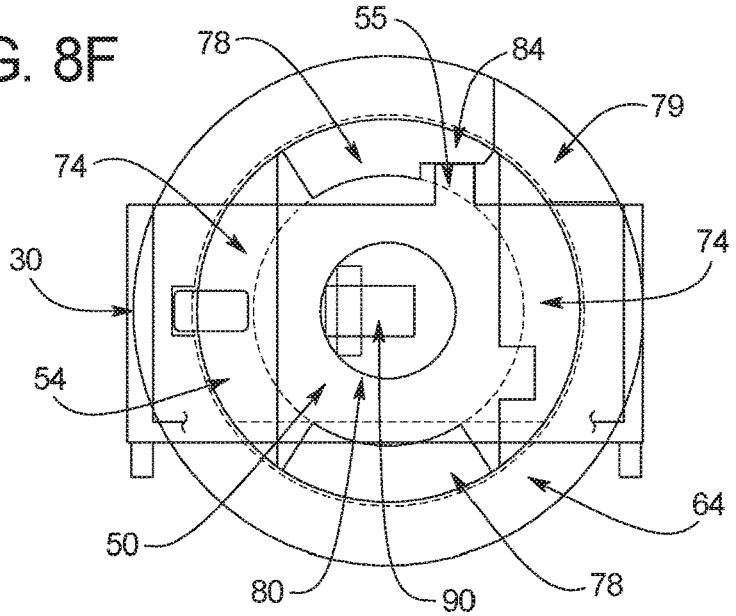
FIG. 8F shows a bottom cross-section view of the configuration of the embodiment of a brush holder assembly shown in FIG. 8E.
Figure 8G:
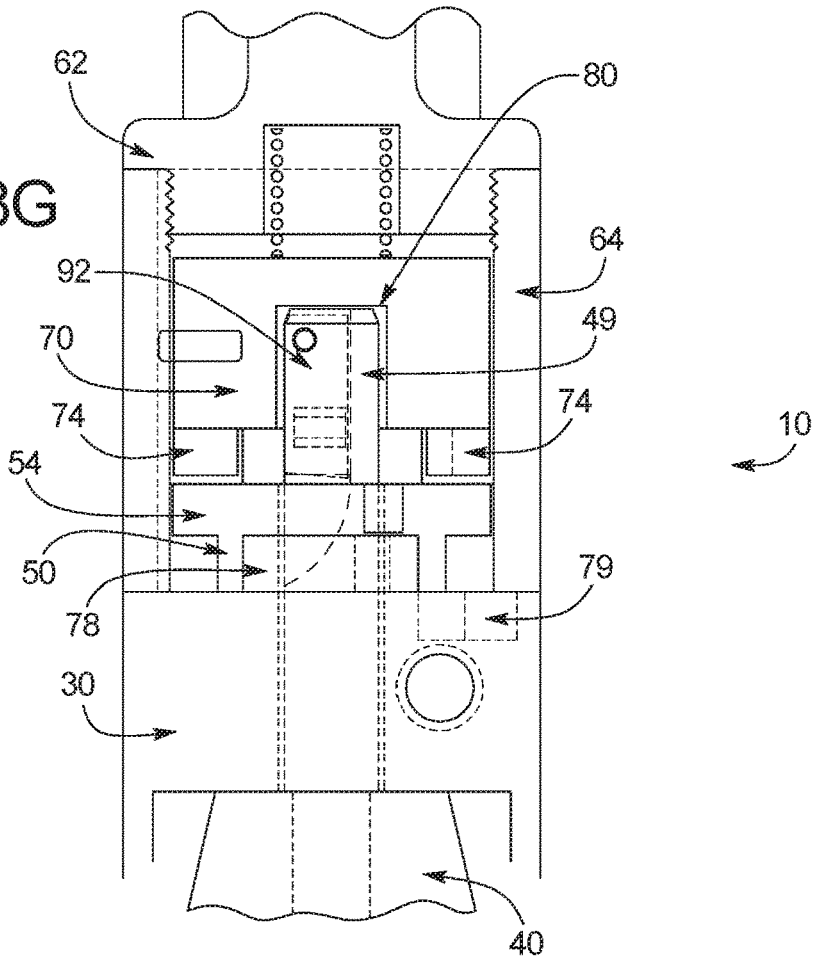
FIG. 8G shows a rear cross-section view of an embodiment of a brush holder assembly provided by the present disclosure.
Figure 8H:
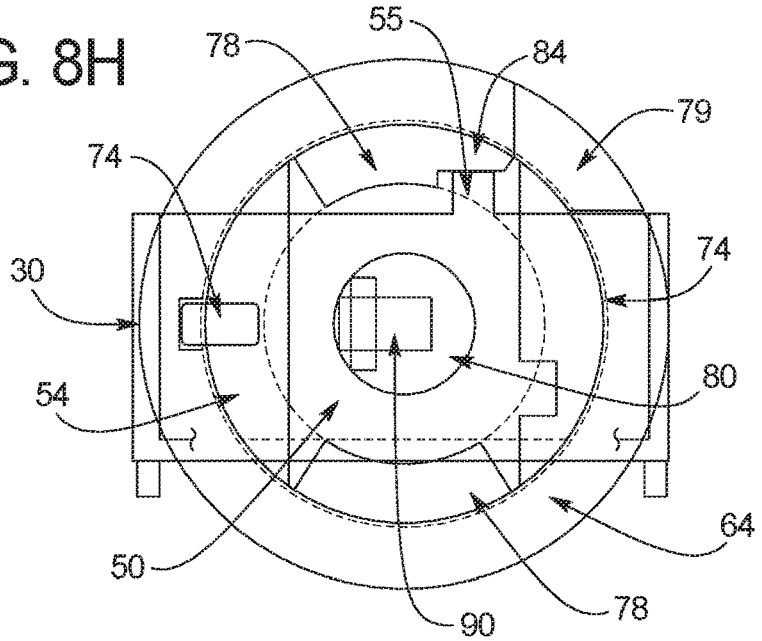
FIG. 8H shows a bottom cross-section view of the configuration of the embodiment of a brush holder assembly shown in FIG. 8G.

As shown in FIGS. 8E and 8F, which depict step (3) of the first method, a user can move the handle 60 to a position directly above the connecting member 50 such that the rocker assembly 90 inserts into the recess 80 of the core 70 of the handle 60. In a preferred embodiment, one of the shell teeth 78 comprises a lateral notch 84. The handle 60 may be rotated until either an "unlock" marking on the handle 60 aligns with indicia (such as a marking or a structure) on the side of the back plate 30 and/or the lateral notch 84 aligns with the boss 55 on the back plate 30. This position ensures that the handle 60 is located on a proper vertical axis and rotation for connection to the brush holder 20. Preferably the stop 79 can be positioned adjacent to the rear exterior surface 31 of the back plate 30. As shown in FIGS. 8G and 8H, which depict step (4) of the first method, a user may move/press the handle 60 onto the upper exterior surface 34 of the back plate 30 such that the connecting member 50 is received by the shell teeth 78 of the handle 60.

In an embodiment, the assembly 10 has a single orientation of the shell 64 that is required for the shell 64 to receive the connecting member 50. For example, as shown in FIG. 8H, insertion of the connecting member 50 into the shell 64 preferably requires that the shell 64 is positioned with the shell teeth 78 offset relative to the locking flange 54 such that the shell teeth 78 do not vertically overlap the locking flange 54. Insertion of the connecting member 50 into the shell 64 preferably requires that the shell 64 is positioned with the lateral notch 84 aligned with the boss 55 of the locking flange 54, as shown in FIG. 8H.

After the shell 64 of the handle 60 is positioned as needed for the shell 64 to receive the connecting member 50, the handle 60 may be moved onto the upper exterior surface 34 of the back plate 30, thereby sliding the shell teeth 78 past the locking flange 54 as the connecting member 50 is received by the shell 64. Sliding the shell teeth 78 past the locking flange 54 positions the locking flange 54 in a horizontal plane that is above the horizontal plane of the shell teeth 78. Sliding the shell teeth 78 past the locking flange 54 can slide the boss 55 through the lateral notch 84 such that the locking flange 54 and the boss 55 move into a horizontal plane that is above the horizontal plane of the shell teeth 78.

Receipt of the connecting member 50 by the shell 64 may insert the post 49 into the recess 80, thereby pushing the core 70 upward due to force from the post 49 against the biasing of the compression spring 72. For example, the post 49 can push the core 70 upward such that the core 70 moves out of contact with the shell teeth 78. Preferably the core 70 is then positioned such that the core teeth 74 are in a horizontal plane that is above the horizontal plane of the locking flange 54 which is above the horizontal plane of the shell teeth 78.

Figure 8I:
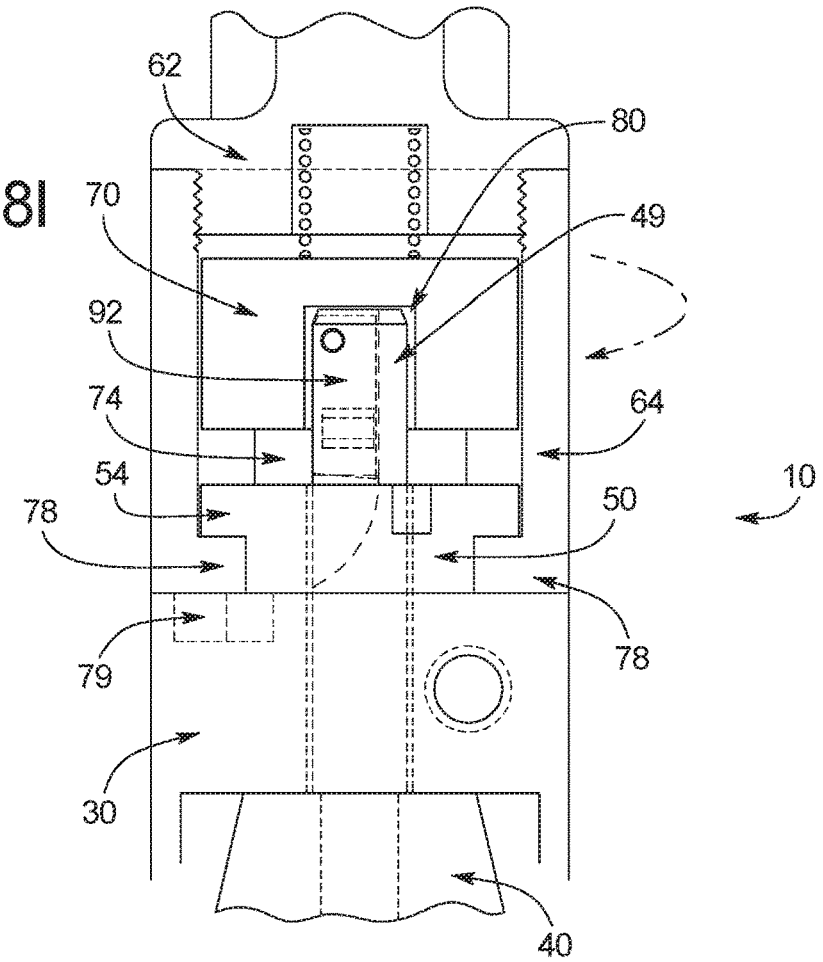
FIG. 8I shows a rear cross-section view of an embodiment of a brush holder assembly provided by the present disclosure.
Figure 8J:
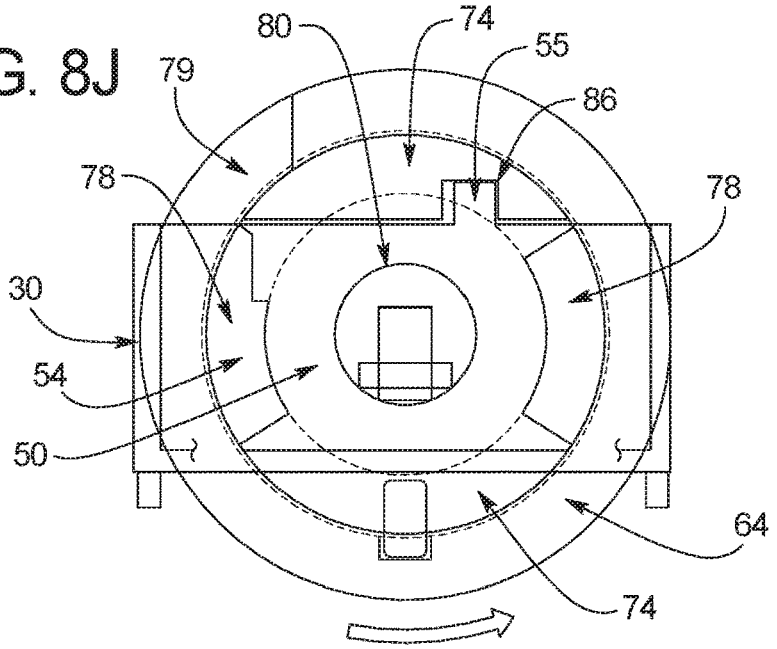
FIG. 8J shows a bottom cross-section view of the configuration of the embodiment of a brush holder assembly shown in FIG. 8I.

As shown in FIGS. 8I and 8J, which depict step (5) of the first method, the handle 60 can be rotated so that the handle 60 is connected to the brush holder 20. To connect the handle 60 to the back plate 30 of the brush holder 20, a user may rotate the handle 60 relative to the brush holder 20. For example, rotating the handle 60 relative to the brush holder 20 can rotate the shell teeth 78 into a position that is underneath and vertically aligned with the locking flange 54. This rotation can position the shell teeth 78 between the locking flange 54 and the upper exterior surface 34 of the brush holder 20 in a vertical direction. In an embodiment, the handle 60 can rotate about ninety degrees, and further rotation is prevented by contact of the stop 79 with the rear exterior surface 31 of the back plate 30. This rotational position is the locked position.

This rotation also vertically aligns the boss 55 with a complementary groove 86 in one of the core teeth 74. In an embodiment, the boss 55 and the complementary groove 86 have substantially the same shape, preferably rectangular, and/or have substantially the same size. With the core 70 pushed upward by the locking flange 54, the complementary groove 86 is positioned in the same horizontal plane as the core teeth 74, which is above the horizontal plane in which the locking flange 54 and the boss 55 are positioned.

Figure 8K:
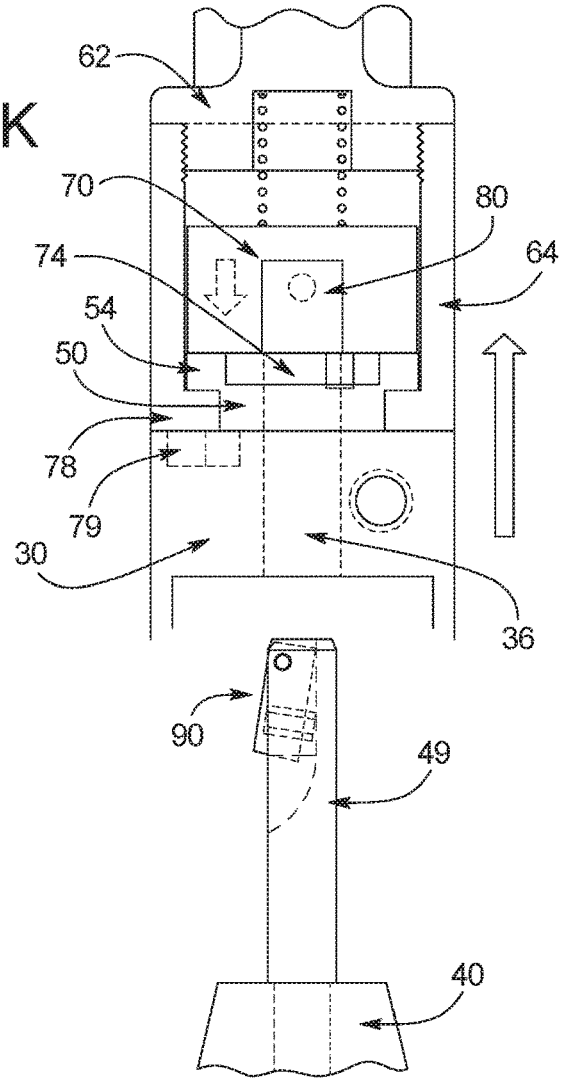
FIG. 8K shows a rear cross-section view of an embodiment of a brush holder assembly provided by the present disclosure.
Figure 8L:
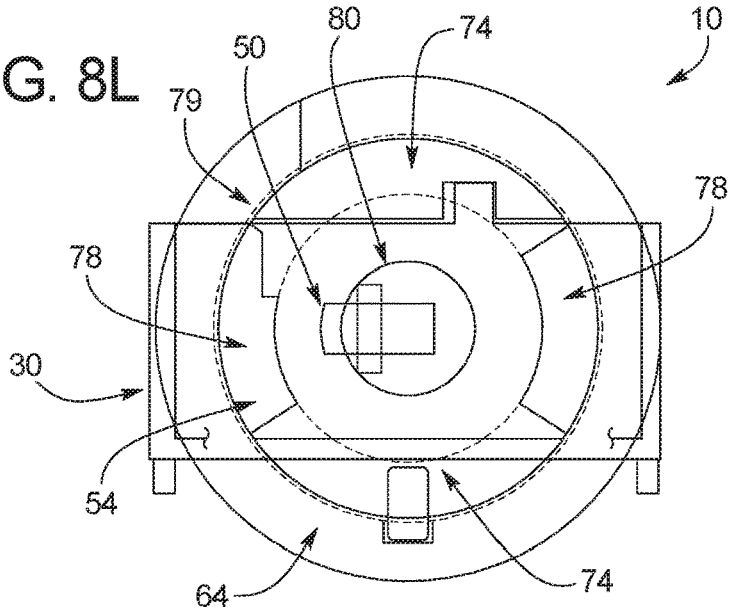
FIG. 8L shows a bottom cross-section view of the configuration of the embodiment of a brush holder assembly shown in FIG. 8K.

As shown in FIGS. 8K and 8L, which depict step (6) of the first method, the brush holder 20 connected to the handle 60 can then be removed from the support 40 to lock the handle 60 to the brush holder 20. For example, a user may pull the handle 60 upward so that the support 40 slides out of the back plate 30 of the brush holder 20.

This action removes the post 49 from the recess 80 of the core 70 to allow the core 70 to drop down on the locking flange 54. The core teeth 74 move into the same horizontal plane as the locking flange 54, with the inner sides of the core teeth 74 abutting the sides of the locking flange 54 and the groove 86 receiving the boss 55. This action effectively locks the handle 60 to the brush holder 20 because the compression spring 72 biases the core 70 down onto the connecting member 50 with the boss 54 within the groove 86 and the core teeth 74 preventing rotation of the locking flange 54. In an embodiment, locking of the handle 60 to the brush holder 20 prevents the handle 60 from being disconnected from the brush holder 20 except by fully seating the brush holder 20 on a support 40 or by a user pulling up the trigger 82 (if the trigger 82 is provided), both discussed in further detail hereafter.

One way to disengage the handle 60 from the brush holder 20 is by a user pulling upward on the trigger 82. Upward movement of the trigger 82 slides the pin 76 upward relative to the shell 64 and thereby slides the core 70 upward in the cavity 66, against the biasing of the compression spring 72. This action moves the groove 86 upward, away from the boss 55, and moves the core teeth 74 upward, away from the locking flange 54. Thus the handle 60 can then be rotated from a position in which the shell teeth 78 are underneath the locking flange 54 (the locked position shown in FIGS. 8K and 8L) back to a position in which the shell teeth 78 are offset from the locking flange 54. Preferably this unlocked position allows the handle 60 to be removed from the back plate 30 of the brush holder 20 by lifting the handle 60 from the upper exterior surface 34 of the back plate 30.

Preferably the handle 60 is rotated relative to the brush holder 20 by approximately ninety degrees to move from the locked position back to the unlocked position, in the opposite direction relative to the rotation that moved the handle 60 from the unlocked position to the locked position. For example, in an embodiment, the handle 60 is rotated clockwise by approximately ninety degrees to move from the unlocked position to the locked position and then rotated counter-clockwise by approximately ninety degrees to return the unlocked position. In another embodiment, the handle 60 is rotated counter-clockwise by approximately ninety degrees to move from the unlocked position to the locked position and then rotated clockwise by approximately ninety degrees to return the unlocked position.

As shown in FIGS. 9A-9H, another way to disengage the handle 60 from the back plate 30 is by fully seating the brush holder 20 on the support 40. These figures also depict a second method provided by the present disclosure that can performed subsequently to the method shown in FIGS. 8A-8L, performed prior to the method shown in FIGS. 8A-8L, or performed independently. The steps disclosed hereafter can be performed in any order and are not limited to the specific order shown in the figures. In these figures, the outer dashed line is the perimeter of the locking flange 54, and the inner, circular dashed line is the perimeter of the connecting member 50.

Figure 9A:
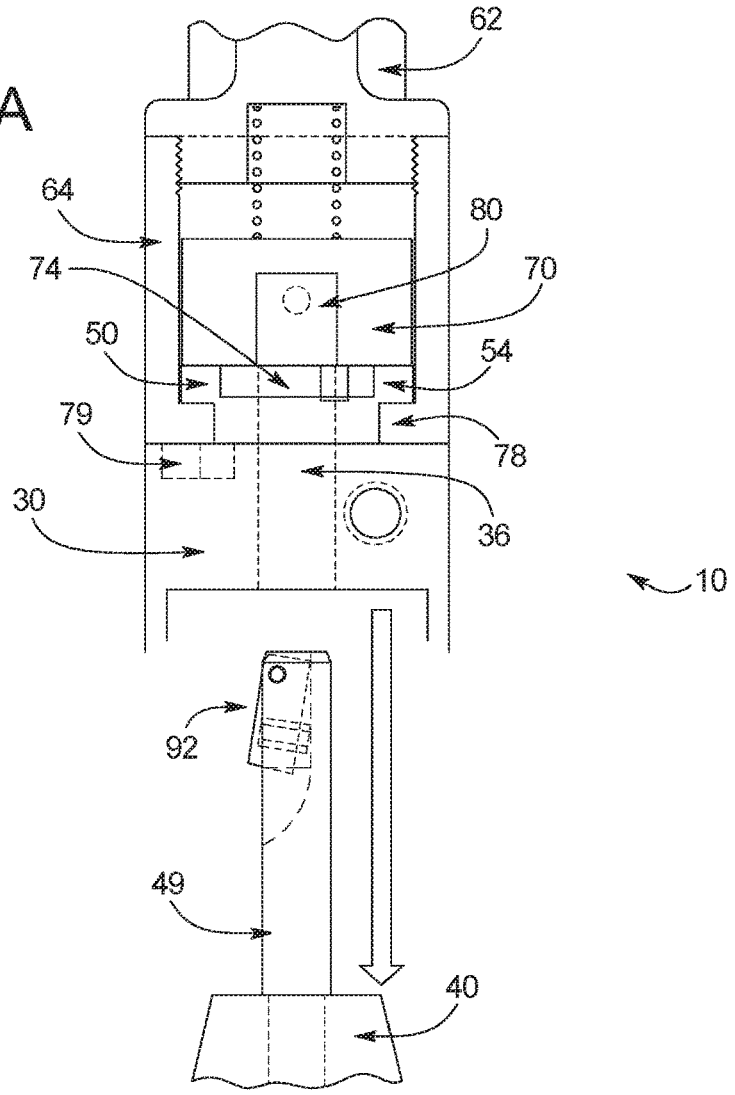
FIG. 9A shows a rear cross-section view of an embodiment of a brush holder assembly provided by the present disclosure.
Figure 9B:
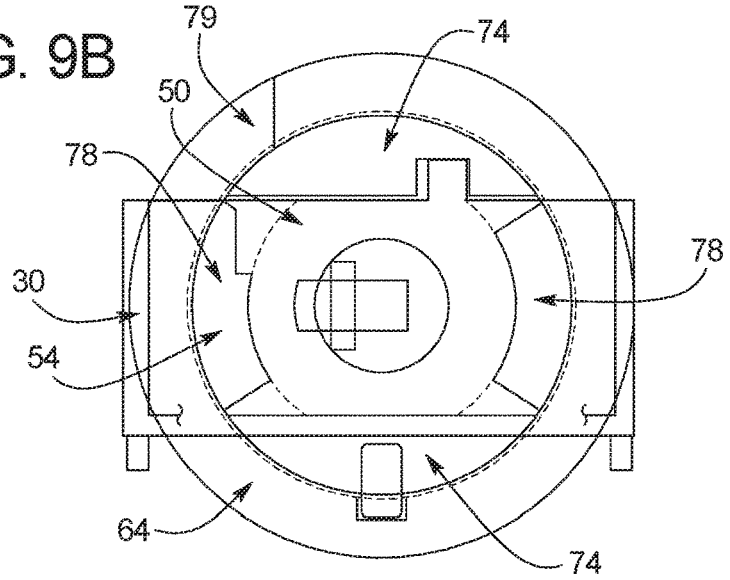
FIG. 9B shows a bottom cross-section view of the configuration of the embodiment of a brush holder assembly shown in FIG. 9A.
Figure 9C:
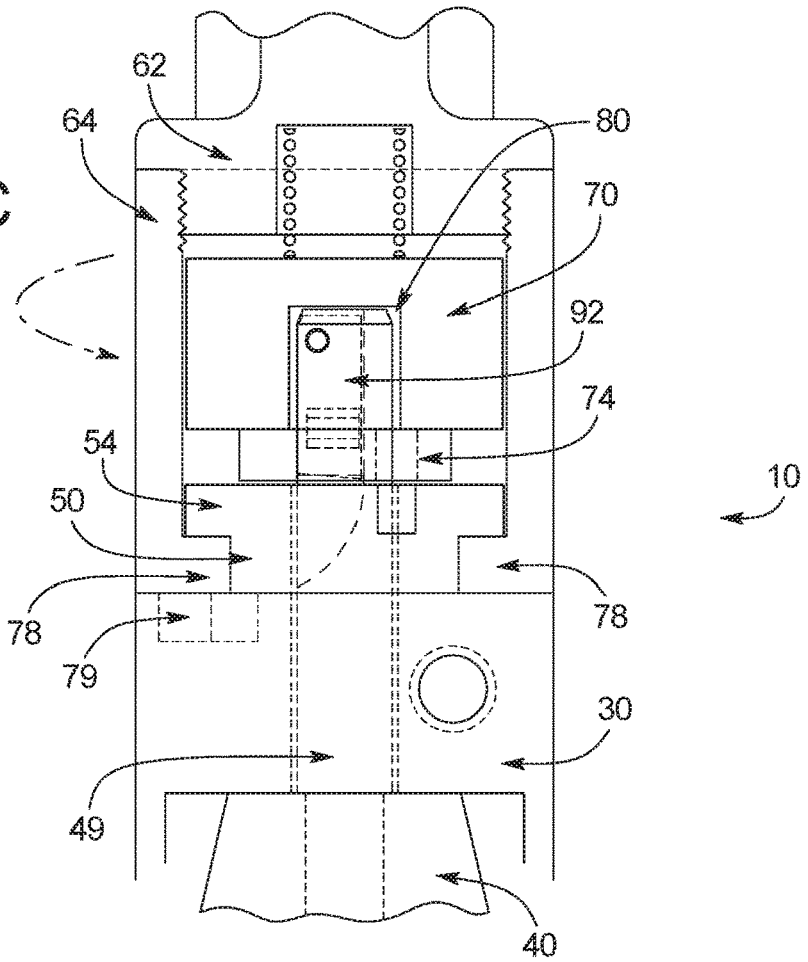
FIG. 9C shows a rear cross-section view of an embodiment of a brush holder assembly provided by the present disclosure.
Figure 9D:
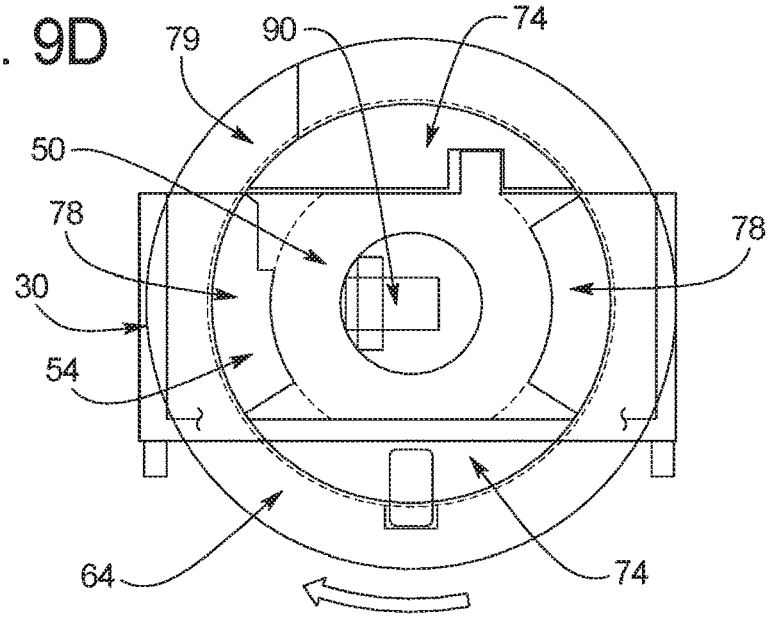
FIG. 9D shows a bottom cross-section view of the configuration of the embodiment of a brush holder assembly shown in FIG. 9C.
Figure 9E:
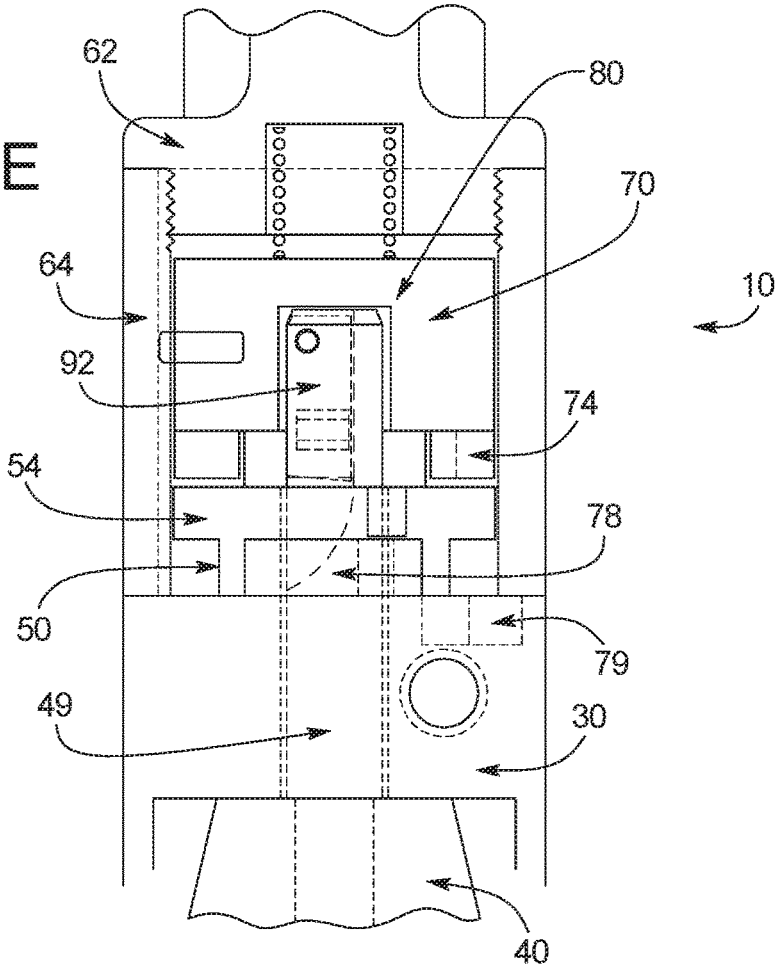
FIG. 9E shows a rear cross-section view of an embodiment of a brush holder assembly provided by the present disclosure.
Figure 9F:
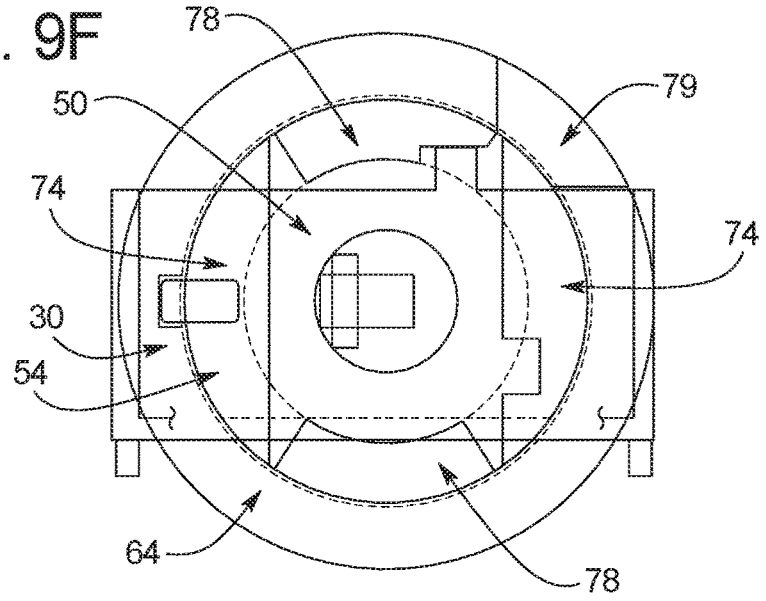
FIG. 9F shows a bottom cross-section view of the configuration of the embodiment of a brush holder assembly shown in FIG. 9E.

As shown in FIGS. 9A and 9B, which depict step (1) of the second method, the brush holder 20 with the handle 60 connected thereto can be aligned with the post 49 of the support 40. As shown in FIGS. 9C and 9D, which depict step (2) of the second method, the brush holder 20 with the handle 60 connected thereto can be seated onto the support 40. Seating the brush holder 20 with the handle 60 connected thereto on the support 40 can insert the post 49 into the recess 80 of the core 70. The post 49 can push the core 70 upward in the cavity 66, against the bias of the compression spring 72.

Figure 9G:
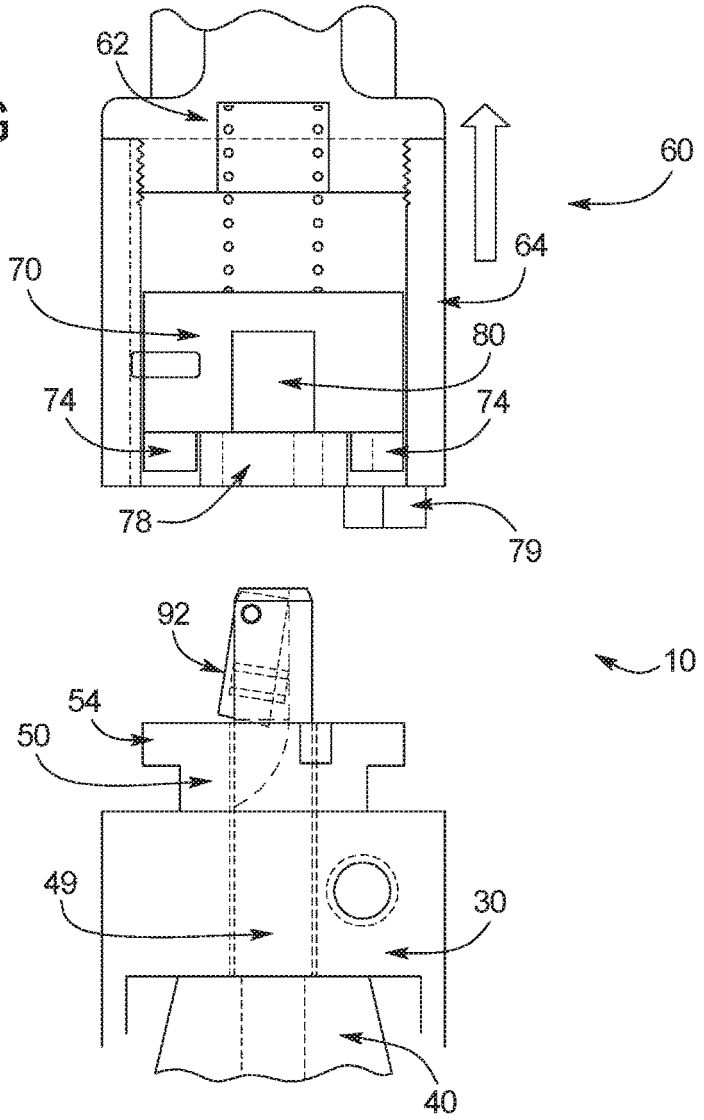
FIG. 9G shows a rear cross-section view of an embodiment of a brush holder assembly provided by the present disclosure.
Figure 9H:
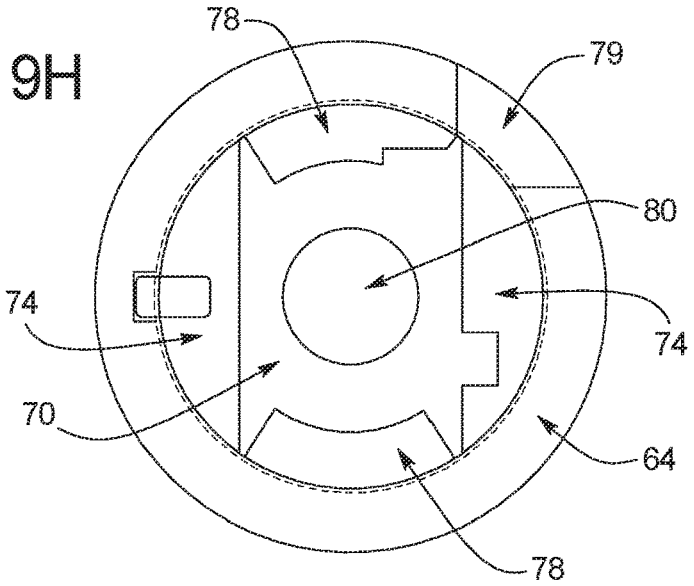
FIG. 9H shows a bottom cross-section view of the configuration of the embodiment of a brush holder assembly shown in FIG. 9G.

This action moves the groove 84 upward, away from the boss 55, and moves the core teeth 74 upward, away from the locking flange 54. Thus the handle 60 can then be rotated (step (3) of the second method) from the locked position in which the shell teeth 78 are underneath the locking flange 54 to the unlocked position shown in FIGS. 9E and 9F in which the shell teeth 78 are offset from the locking flange 54. This unlocked position preferably allows the handle 60 to be removed from the back plate 30 of the brush holder 20 by lifting the handle 60 from the upper exterior surface 34 of the back plate 30, as shown in FIGS. 9G and 9H which depict step (4) of the second method. As noted above, preferably the handle 60 is rotated relative to the brush holder 20 by approximately ninety degrees to move from the unlocked position to the locked position and rotated in the opposite direction by approximately ninety degrees to return the unlocked position.

This action frees the rocker assembly 90 from a restrictive circumference of the recess 80, allowing the rocker spring 96 to extend and bias the rocker arm 92 outward relative to the post 49. Extension of the rocker arm 92 outward from the post 49 provides a visual indication that the brush holder 20 is fully seated on the support 40.

The brush holder assembly 10 can be used in a process for replacing a brush used with a rotating device and/or a process for replacing a brush holder used with a rotating device. One or both of the first and second methods disclosed above can be implemented in a process for replacing a brush used with a rotating device and/or a process for replacing a brush holder used with a rotating device.

Accordingly, the present disclosure provides a method of replacing a brush on an operating apparatus, the method comprising (a) positioning a handle on a brush holder, in which the brush is at least partially positioned, while the brush holder is connected to a support comprising a post, wherein the positioning of the handle on the brush holder/support assembly inserts the recess in a core moveably positioned in a cavity of the handle into the post; (b) rotating the handle relative to the brush holder in a first direction of handle rotation that is clockwise or counter-clockwise to connect the handle to the brush holder; (c) removing the brush holder from the support by pulling the handle with the handle attached to the brush holder; (d) removing the brush, during which the handle may or may not be attached to the brush holder; (e) positioning a replacement brush at least partially in the brush holder, during which the handle may or may not be attached to the brush holder; (f) using the handle to position the brush holder with the handle attached and with the replacement brush on a support; (g) then rotating the handle in a second direction that is opposite to the first direction to release the handle from the brush holder; (h) then removing the handle from the brush holder.

Step (a) can comprise one or more of (i) receiving a connecting member located on the brush holder in a shell that forms the base of the handle; (ii) positioning inward-directed horizontal teeth of the handle on opposite sides of a locking flange on the brush holder, (iii) aligning a boss located on a connecting member with a notch in the handle, or (iv) the recess depressing a rocker arm located on the post.

Step (b) can comprise one or more of (i) rotating the handle approximately ninety degrees relative to the brush holder, (ii) limiting the handle rotation to about ninety degrees, (iii) rotating inward-directed horizontal teeth of the handle from a position offset relative to a locking flange on the brush holder to a position underneath the locking flange in a vertical direction, (iv) rotating downward-directed teeth in the handle from a position vertically overlapping a locking flange located on the brush holder to a position offset relative to the locking flange, or (v) vertically aligning a boss on a connecting member located on the brush holder with a complementary groove provided by the core.

Step (c) can comprise one or more of (i) removing the brush holder from the post, (ii) removing the recess in the core from the post, (iii) aligning a complementary groove provided by the core to pass by a boss located on a connecting member, (iv) sliding the core downward in the cavity, or (iv) releasing a rocker arm on the post as the core recess is removed.

Step (e) can comprise one or more of (i) a brush changing fixture/support cam displacing the end of a retainer out of the brush box with the brush held above the end of the retainer, allowing insertion of a brush in the box, or (ii) release of the end of a retainer when the brush holder is removed from the fixture, allowing the retainer to hold the brush in the box.

Step (f) can comprise one or more of (i) sliding the brush holder onto the post, (ii) receiving the post in the recess of the core, or (iii) the recess depressing a rocker arm located on the post.

Step (g) can comprise one or more of (i) rotating the handle approximately ninety degrees relative to the brush holder, (ii) rotating inward-directed horizontal teeth of the handle from a position underneath the locking flange on the brush holder in a vertical direction to a position offset relative to a locking flange located on the brush holder, (iii) rotating downward-directed teeth in the handle from a position offset relative to the locking flange to a position vertically overlapping a locking flange on the brush holder, (iv) limiting the handle rotation to about ninety degrees, or (v) moving a connecting member on the brush holder out of vertical alignment with a complementary groove provided by the core.

Step (h) can comprise one or more of (i) removing the post from the recess in the core, (ii) sliding the core downward in the cavity, (iv) the recess releasing a rocker arm on the post, or (v) interlocking the handle so the handle is not removable until the brush holder is completely seated on the support.

The present disclosure also provides a method of replacing a brush holder, the method comprising (a) positioning a handle on the brush holder while the brush holder is connected to a support comprising a post, wherein the positioning of the handle on the brush holder inserts the post into a recess in a core moveably positioned in a cavity of the handle; (b) rotating the handle relative to the brush holder in a first direction that is clockwise or counter-clockwise to connect the handle to the brush holder; (c) removing the brush holder from the support by pulling the handle while the handle is attached to the brush holder; (d) rotating the handle relative to the brush holder while pulling a trigger on the handle that moves the core upward in the cavity; (e) removing the handle from the brush holder; (f) positioning the handle on a replacement brush holder; (g) rotating the handle relative to the replacement brush holder to connect the handle to the replacement brush holder; (h) using the handle to position the replacement brush holder on the support; (i) then rotating the handle in a second direction that is opposite to the first direction; and (j) then removing the handle from the replacement brush holder.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method of replacing a brush holder, the method comprising:

positioning a handle on the brush holder while the brush holder is connected to a support;

rotating the handle relative to the brush holder in a first direction that is clockwise or counter-clockwise to connect the handle to the brush holder;

removing the brush holder from the support by pulling the handle with the handle attached to the brush holder;

rotating the handle relative to the brush holder in a second direction that is opposite to the first direction while pulling a trigger on the handle that moves a core in the handle upward in a cavity in the handle; and removing the handle from the brush holder, wherein the positioning of the handle on the brush holder receives a connecting member on the brush holder in the handle, wherein the connecting member comprises a locking flange that extends outward in a horizontal direction from opposite sides of the connecting member.

2. The method of claim 1, wherein the handle comprises a spring that biases the core downward.

3. The method of claim 1, wherein the removing of the brush holder from the support slides the core downward in the cavity.

4. The method of claim 1, wherein the handle further comprises a shell that receives the connecting member when the handle is positioned on the brush holder.

5. A method of replacing a brush holder, the method comprising:

positioning a handle on the brush holder while the brush holder is connected to a support;

rotating the handle relative to the brush holder in a first direction that is clockwise or counter-clockwise to connect the handle to the brush holder;

removing the brush holder from the support by pulling the handle with the handle attached to the brush holder;

rotating the handle relative to the brush holder in a second direction that is opposite to the first direction while pulling a trigger on the handle that moves a core in the handle upward in a cavity in the handle; and removing the handle from the brush holder, wherein the positioning of the handle on the brush holder receives a connecting member on the brush holder in the handle, wherein the rotating of the handle in the first direction relative to the brush holder vertically aligns a boss on the connecting member with a complementary groove provided by the core.

6. The method of claim 5, wherein the core comprises teeth that extend downward from opposite sides of the core, and one of the teeth comprise the complementary groove that receives the boss.

7. A method of replacing a brush holder, the method comprising:

positioning a handle on the brush holder while the brush holder is connected to a support;

rotating the handle relative to the brush holder in a first direction that is clockwise or counter-clockwise to connect the handle to the brush holder;

removing the brush holder from the support by pulling the handle with the handle attached to the brush holder;

rotating the handle relative to the brush holder in a second direction that is opposite to the first direction while pulling a trigger on the handle that moves a core in the handle upward in a cavity in the handle; and removing the handle from the brush holder, wherein the positioning of the handle on the brush holder receives a connecting member on the brush holder in the handle, wherein the connecting member extends outward from a surface of the brush holder, and the brush holder comprises a bore that extends from an opening in the connecting member to an opening on the surface of the brush holder.

8. The method of claim 7, wherein the brush holder comprises a brush box that receives a brush, the brush holder further comprises a back plate fixed to the brush box, and the back plate comprises the surface from which the connecting member extends.

9. The method of claim 8, wherein the support comprises a body and a flange that extends from opposite sides of the body, and the back plate of the brush holder receives the support.

10. The method of claim 7, wherein the support comprises a post having a length, the bore having a length less than the length of the post, and the positioning of the handle on the brush holder depresses a rocker arm on the post.

11. The method of claim 10, wherein the removing of the brush holder from the support rotates the rocker arm on the post.

12. The method of claim 10, wherein the positioning of the handle on the brush holder inserts the post into a recess in the core moveably positioned in the cavity of the handle.

13. The method of claim 12, wherein the post has a radius substantially the same as a radius of the recess in the core.

14. The method of claim 12, wherein the removing of the brush holder from the support removes the post from the recess in the core.

15. The method of claim 7, wherein the handle comprises a spring that biases the core downward.

16. The method of claim 7, wherein the removing of the brush holder from the support slides the core downward in the cavity.

17. A method of replacing a brush holder, the method comprising:

positioning a handle on the brush holder while the brush holder is connected to a support;

rotating the handle relative to the brush holder in a first direction that is clockwise or counter-clockwise to connect the handle to the brush holder;

removing the brush holder from the support by pulling the handle with the handle attached to the brush holder;

rotating the handle relative to the brush holder in a second direction that is opposite to the first direction while pulling a trigger on the handle that moves a core in the handle upward in a cavity in the handle; and removing the handle from the brush holder, wherein the positioning of the handle on the brush holder receives a connecting member on the brush holder in the handle, wherein the handle further comprises a shell that receives the connecting member when the handle is positioned on the brush holder, wherein the shell defines the cavity in which the core is moveably positioned.

18. The method of claim 17, wherein the handle comprises a spring that biases the core downward, wherein the removing of the brush holder from the support slides the core downward in the cavity.

19. A method of replacing a brush holder, the method comprising:

positioning a handle on the brush holder while the brush holder is connected to a support;

rotating the handle relative to the brush holder in a first direction that is clockwise or counter-clockwise to connect the handle to the brush holder;

removing the brush holder from the support by pulling the handle with the handle attached to the brush holder;

rotating the handle relative to the brush holder in a second direction that is opposite to the first direction while pulling a trigger on the handle that moves a core in the handle upward in a cavity in the handle; and removing the handle from the brush holder, wherein the positioning of the handle on the brush holder receives a connecting member on the brush holder in the handle, wherein the handle further comprises a shell that receives the connecting member when the handle is positioned on the brush holder, wherein the shell comprises teeth that extend inward into the cavity in a horizontal direction.

20. The method of claim 19, wherein the handle comprises a spring that biases the core downward, wherein the removing of the brush holder from the support slides the core downward in the cavity.

* * * * *